US006461204B1

(12) United States Patent
Takura et al.

(10) Patent No.: US 6,461,204 B1
(45) Date of Patent: Oct. 8, 2002

(54) SWIMMING ASSISTANCE APPARATUS

(75) Inventors: Toshiyasu Takura, Hino (JP); Yoshifumi Tanabe, Yokkamachi (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/578,036

(22) Filed: May 25, 2000

(30) Foreign Application Priority Data

May 25, 1999 (JP) ..... 11-144870
Jul. 13, 1999 (JP) ..... 11-198778
Feb. 14, 2000 (JP) ..... 2000-035904

(51) Int. Cl.[7] ..... B60L 11/18
(52) U.S. Cl. ..... 440/6; 114/315
(58) Field of Search ..... 114/315; 440/6, 440/38; 441/65; 405/186; 60/221, 222

(56) References Cited

U.S. PATENT DOCUMENTS 2,691,784 A * 10/1954 Eckl ..... 440/87
2,722,021 A * 11/1955 Keogh-Dwyer ..... 114/315
3,014,448 A * 12/1961 Fogarty et al. ..... 440/1
3,329,118 A * 7/1967 Strader ..... 114/315
3,358,635 A * 12/1967 McRee ..... 440/87
3,441,952 A * 4/1969 Strader ..... 440/6
3,466,798 A * 9/1969 Speers et al. ..... 446/162
3,584,594 A * 6/1971 Poutout ..... 114/315
3,638,353 A * 2/1972 Frye et al. ..... 446/156
3,708,251 A * 1/1973 Pierro ..... 417/356
3,716,013 A * 2/1973 Vasilatos ..... 441/55
3,721,208 A * 3/1973 Lampert et al. ..... 440/38
3,789,788 A * 2/1974 Peroni ..... 114/315
3,791,331 A * 2/1974 Dilley ..... 115/17
3,985,094 A 10/1976 Stricker
4,068,657 A * 1/1978 Kobzan ..... 128/142 R
4,467,742 A * 8/1984 Duboy ..... 114/315
4,831,297 A * 5/1989 Taylor et al. ..... 310/87
4,864,959 A * 9/1989 Takamizawa et al. ..... 114/315
4,952,095 A * 8/1990 Walters ..... 405/186
4,962,717 A 10/1990 Tsumiyama
4,996,938 A * 3/1991 Cameron et al. ..... 114/315
D323,808 S * 2/1992 DeSantis ..... D12/308
5,158,034 A * 10/1992 Hsu ..... 114/315
5,303,666 A * 4/1994 DeSantis et al. ..... 114/315
5,379,714 A * 1/1995 Lewis et al. ..... 114/315
5,388,543 A * 2/1995 Ditchfield ..... 114/242
5,396,860 A * 3/1995 Cheng ..... 114/315
5,399,111 A * 3/1995 Kobayashi et al. ..... 440/6
5,423,278 A * 6/1995 Lashman ..... 114/315
5,469,803 A * 11/1995 Gallo ..... 114/315
5,704,817 A * 1/1998 Vaughn ..... 440/33
5,947,782 A * 9/1999 Siladke et al. ..... 441/129

FOREIGN PATENT DOCUMENTS

DE 2100827 * 7/1972 ..... 114/315
DE 2309653 * 8/1974 ..... 114/315
DE 3513515 * 10/1986 ..... 114/315

(List continued on next page.)

*Primary Examiner*—S. Joseph Morano
*Assistant Examiner*—Ajay Vasudeva
(74) *Attorney, Agent, or Firm*—Oblon, Spivak, McClelland, Maier & Neustadt, P.C.

(57) ABSTRACT

A swimming assistance apparatus according to the present invention includes a base combined with a human body and a motor-driven pump provided in a base. The motor-driven pump has a water inlet and a water outlet to operate by a battery so as to generate water flow from the water inlet to the water outlet. Several kinds of structure can be used for the base. For example, a buoyant hull having a pair of grips at front sides and a controller adjacent to the grips, a base having a handle, the buoyancy of which is set little higher more than 0 and a belt detachably attached to a human body can be used for the base. The swimming assistance apparatus according to the present invention uses the motor-driven pump as driving source, so that the apparatus can be made smaller and lighter, and the apparatus can improve safety.

39 Claims, 29 Drawing Sheets

FOREIGN PATENT DOCUMENTS

| | | | | |
|---|---|---|---|---|
| DE | 4127497 | * | 2/1993 | ..... 114/315 |
| FR | 2608441 | * | 6/1988 | ..... 114/315 |
| GB | 25859 | * | 5/1919 | ..... 114/315 |
| JP | 49-77393 | | 7/1974 | |
| JP | 55-106886 | | 8/1980 | |
| JP | 57-185875 | | 11/1982 | |
| JP | 61-125994 | * | 6/1986 | ..... 440/6 |
| JP | 61-1259923 | * | 6/1986 | ..... 440/6 |
| JP | 62-283095 | * | 12/1987 | ..... 114/315 |
| JP | 63-17196 | * | 1/1988 | ..... 114/315 |
| JP | 1-101294 | * | 4/1989 | ..... 114/315 |
| JP | 04-231276 | * | 8/1992 | ..... 440/6 |
| JP | 04-356294 | * | 12/1992 | ..... 441/65 |
| JP | 5-58388 | | 3/1993 | |
| JP | 5-345591 | | 12/1993 | |
| JP | 10-246193 | | 9/1998 | |
| JP | 11-267246 | | 10/1999 | |
| WO | WO 9200124 | * | 1/1992 | ..... 114/315 |

* cited by examiner

Fig. 8
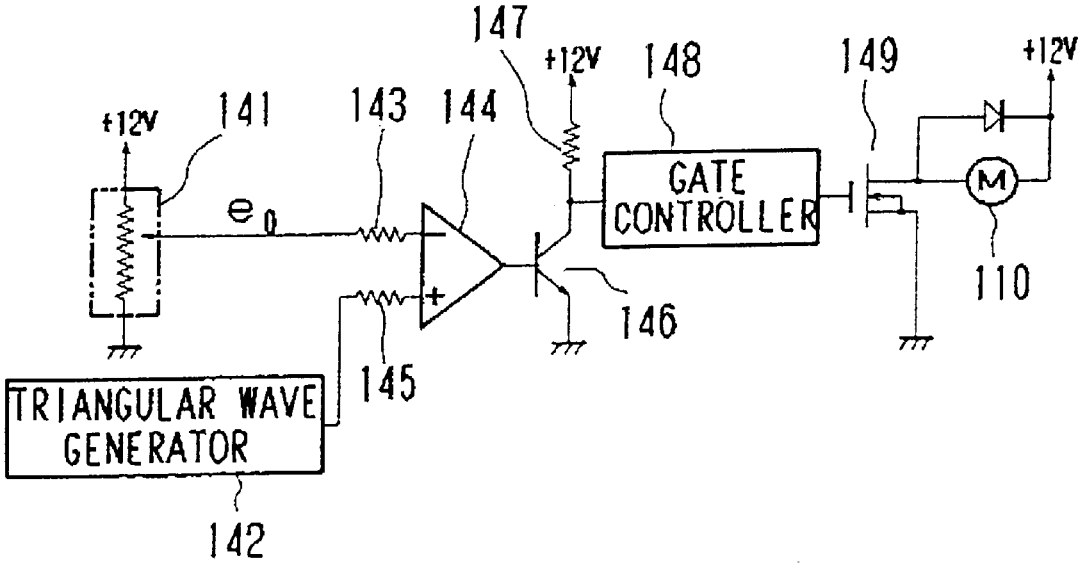
Fig. 9(A)
Fig. 9(B)
Fig. 9(C)
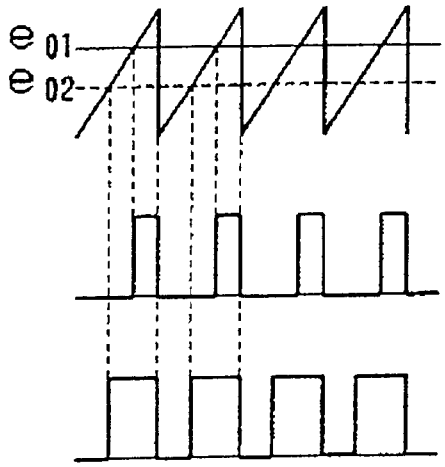

SWIMMING ASSISTANCE APPARATUS

BACKGROUND OF THE INVENTION

1. Field of the Invention

The present invention relates to a swimming assistance apparatus using a motor-driven pump to be capable of generating water flow. The present invention also relates to a swimming assistance apparatus to be able to be used in various purposes such as marine sports, driving at water surface with a user or going underwater with the user for instance, practical use, towing surfboards or water boats for instance, or the like. The present invention also relates to a swimming assistance apparatus being capable of attaching to the human body to assist swimming movements.

2. Description of the Prior Art

Several kinds of swimming assistance apparatus for assisting swimming movements are utilized. These swimming assistance apparatuses are structured according to the purpose thereof. Thus, some swimming assistance apparatuses are now introduced with classification as follows.

(Apparatuses for Making People Familiar with Water)

A swimming ring or a swimming float or the like is popular for beginners of swimming or old people for instance. These swimming ring and swimming float, generally, stores air with airtight so as to float on water. The swimming ring has doughnut-like form The swimming float is given several forms such as mat, animal or something like that. The swimming ring and the swimming float are, generally, used for making the beginners of swimming such as children familiar with water, or for the people who is weak such as old people to enjoy swimming.

Especially, the swimming ring can be easily worn. Thus, it is popular to use for water rescue. A life jacket is also popular for water rescue.

Japanese laid open publication document Hei 11-267246 discloses a swimming ring which is capable of wearing tightly. The swimming ring comprises a ring-like float and jacket-like wear attached to the float to allow wearing with upper half of the body.

(Apparatuses for Practice of Swimming)

A floating plate, so-called beat plate, having same function, which can float, to the swimming ring and the swimming float is also popular. But, floating plate is most frequently uses for practice of swimming. The floating plate is a plate-like float consisting of a material which can float. In case the float plate is held in hand, the float plate is used as practice for butterfly kick for instance. In case the float plate is caught with legs, the floating plate is used as practice for crawl stroke or butterfly stroke for instance.

(Apparatuses for Mainly Using for Marine Sports)

As a swimming assistance apparatus being suitable for marine sports, a swimming assistance apparatus having power source for generating driving power in water is popular. This apparatus, generally, provides a handle for allowing grip to assist swimming on water surface or underwater by driving power. As this kind of swimming assistance apparatus, a surfboard having power source is well known. For example, Japanese laid open publication document Sho 55-106886 discloses a surfboard, a power source using turbo fan of which is attached rear portion of the board. The surfboard disclosed in this document provides a water inlet and a water outlet to drive the surfboard with exhaustion of pressed water. Japanese laid open publication document Sho 57-185875 discloses a surfboard, an engine driving a propeller of which is attached rear portion of the board. The propeller is driven to rotate so as to generate driving power. Same kinds of swimming assistance apparatuses are also disclosed in Japanese laid open publication documents Hei 2-143398 and Hei 5-58388. The former one, that is, Hei 2-143398 discloses a water surface and underwater driving apparatus which provides a cylindrical base having oval form at the front and rear portion to provide a battery in the base. At rear portion of the base, a motor driven by the battery is attached. A propeller is provided so as to connect with an axis of the motor. The propeller is surrounded with a water lead ring. The later one, that is, Hei 5-58388 discloses a water surface and underwater driving apparatus which provides a cylindrical base having oval form at the front and rear portion to provide a battery and a motor in the base. A propeller is provided so as to connect with an axis of the motor via a speed reducer. The propeller is surrounded with a water lead ring. Further, Japanese laid open publication document Sho 49-77393 discloses a swimming assistance apparatus having a swimming ring holding chest as well as. a power source for generating driving power in water.

Above-mentioned swimming assistance apparatuses are used not only for marine sports but also for underwater or undersea investigation.

Disadvantages of the above apparatus having power source are now described as follows.

Conventional apparatus, generally, uses propeller for generating driving force in water. Thus, this kind of apparatus is big size and heavy. Especially, if the base does not float on water, another apparatus having floating function such as boat is required for use on water. Thus, it is inconvenient for transportation or storage on water.

Motor locked or propeller broken may occur in case foreign matter such as seaweed or the like got twisted round the propeller. Safety mechanism such as clutch mechanism for automatically breaking off the transmission from the power source to the propeller should be provided in order to prevent such accident. This requirement makes the apparatus complicate.

It is necessary to take off the float for using underwater. In this case, specific gravity of the base is heavier than that of water, so that the apparatus sink if operator set the handle free. Thus, it is difficult to recover the apparatus. As bat situation, in case the motor or engine was stopped with certain reason while driving underwater, it is difficult to lift the heavy base. Thus, the operator should abandon the recovery of the apparatus in such situation.

Additionally, because the surfboard is not small, the swimming apparatus using the surfboard cannot obtain down sizing and low cost to manufacture. Further, practice is necessary to ride on the surf, so that user is limited so as to not use enjoyably for ordinary people.

Disadvantages of the above swimming assistance apparatus.

Several kinds of swimming assistance apparatuses are utilized according to purpose to use.

However, the swimming assistance apparatus which can satisfy any purposes such as the purpose for making people familiar with water, purpose for practice of swimming, purpose for marine sports or the like are not utilized. In another aspect, the swimming assistance apparatuses are extremely classified being suitable for single purpose. Thus, the swimming apparatus being suitable for any purpose with single apparatus is not utilized.

Especially, the swimming apparatus having power source is not enough small for making people familiar with water or for practice of swimming. In technical aspect, such swimming apparatus having power source has disadvantage being bigger. The disadvantage prevents utilizing of the swimming assistance apparatus which can satisfy any purposes with single apparatus.

Additionally, the swimming apparatus having power source requires holding or gripping by the operator so as to not set free his or her arm movement. This is another disadvantage of the swimming apparatus having power source.

The disadvantage that prevents operator's arm movement is common to many swimming assistance apparatus. For example, the swimming ring is held with arms so as to not set free arms movement. Many kinds of swimming float are caught with hands so as to not set free hands movement. The float plate is same. In case the float plate is used as being caught with legs, the float plate prevents legs movement.

Further, it is required to be capable using both underwater and on water surface as a condition for a swimming assistance apparatus which can satisfy any purposes. However, the apparatus floated on water such as the swimming ring, the swimming float, the float plate or the like is essentially hot suitable for using underwater.

SUMMARY OF THE INVENTION

Accordingly, an object of the present invention is to provide a swimming assistance apparatus having a lightweight, which can be easily handled.

Another object of the present invention is to provide a swimming assistance apparatus having a small size, which can be easily handled.

Another object of the present invention is to provide a swimming assistance apparatus which is inexpensive to manufacture.

Another object of the present invention is to provide a swimming assistance apparatus which can improve safety.

Another object of the present invention is to provide a swimming assistance apparatus-which can be easily recovered from underwater.

Another object of the present invention is to provide a swimming assistance apparatus having high utility, which can be easily used without practice in beach for instance.

Another object of the present invention is to provide a swimming assistance apparatus can be used for various purposes.

A further object of the present invention is to provide a swimming assistance apparatus not prevent swimming movement.

These and further object of the present invention are achieved by the novel swimming assistance apparatus of the present invention.

According to the novel swimming assistance apparatus of the present invention, in one aspect thereof, comprises a base combined with a human body and a motor-driven pump provided in the base. The motor-driven pump has a water inlet and a water outlet to operate by a battery so as to generate water flow from the water inlet to the water outlet. Accordingly, the swimming assistance apparatus of the present invention has a lightweight and a small size, which can be easily handle and is inexpensive to manufacture. The swimming assistance apparatus of the present invention can also improve safety.

According to the novel swimming assistance apparatus of the present invention, in another aspect thereof, comprises a buoyant hull having a pair of grips at front sides and a controller adjacent to the grips, a motor-driven pump provided in the hull and a control device. The motor-driven pump has a water inlet and a water outlet to operate by a battery so as to generate water flow from. the water inlet to the water outlet. The control device controls power of the motor-driven pump according to operation of the controller. Accordingly, the swimming assistance apparatus of the present invention has high utility, which can be easily used without practice in beach for instance.

According to the novel swimming assistance apparatus of the present invention, in another aspect thereof, comprise a base having a handle and a motor-driven pump. The motor-driven pump is provided in a channel which connects a water inlet disposed in the draught of the front portion of the base or the bottom of the base with a water outlet disposed in the draught of the rear portion of the base. The motor-driven pump operates by a battery so as to generate water flow from the water inlet to the water outlet, so that the swimming assistance apparatus is driven by reaction of the water flow generated by the motor-driven pump. The base of the present invention, the buoyancy of which is set little higher more than 0, so as to be able to easily recovered from underwater.

According to the novel swimming-assistance apparatus of the present invention, in further aspect thereof, comprises a belt detachably attached to a trunk of a human body and a motor-driven pump. The motor-driven pump has a water inlet and a water outlet and provided on the belt so as to position the water inlet in high and the water outlet in low to the human body, the motor-driven pump operates by a battery so as to generate water flow from the water inlet to the water outlet. Accordingly, the swimming assistance apparatus is driven by reaction of the water flow generated by the motor-driven pump while the swimming assistance apparatus is attached to the human body, so that the swimming assistance apparatus does not prevent swimming movement and can be used at underwater as well as water surface.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which:

FIG. 8 is a circuit diagram for controlling the motor-driven pump according to the first embodiment of the present invention;

FIG. 9 is a waveform chart for explaining velocity control of the motor-driven pump according to the first embodiment of the present invention;

DETAILED DESCRIPTION OF THE PREFERRED EMBODIMENTS

A First Embodiment of the Present Invention

A first embodiment of the present invention is now explained with reference to FIGS. 1 to 9.

Figure 1:
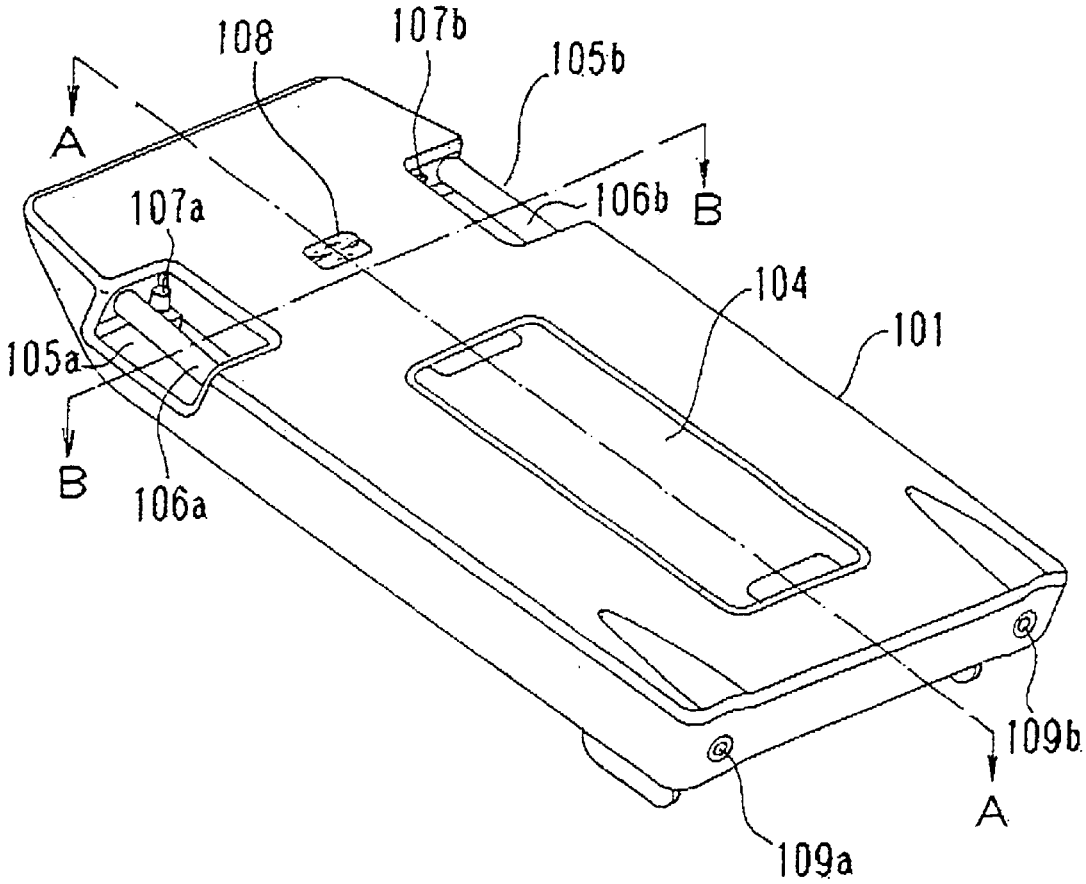
FIG. 1 is a perspective view illustrating the external appearance of the swimming assistance apparatus according to a first embodiment of the present invention.

FIG. 1 is a perspective view illustrating the external appearance of the swimming assistance apparatus according to the present invention. 101 designates to a hull as a base. The hull 101 has a width in almost equal size to the breadth of the human's shoulder and a length in a size allowing the ride with the upper half of the body so as to carry the swimming assistance apparatus easily.

Figure 2:
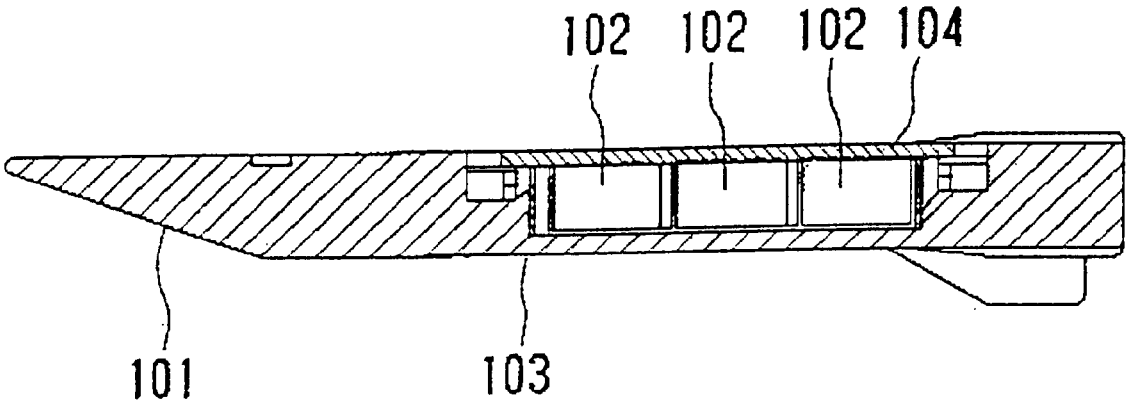
FIG. 2 is a sectional view taken substantially along the lines A—A of FIG. 1.

In center portion of the hull, as shown in A—A section of FIG. 2, there is provided a hold 3 to be capable of holding a battery 102. A lid 104 is also provided on the hold 103 so as to prevent inflow of water by rubber seal for instance. The battery 102 is arranged adjacent to the center of gravity of the hull 101. The battery 102 held in the hold 103 can be detached with opening of. the lid 104.

A pair of recesses 105 is provided at front sides of the hull 101. As shown in B—B section of FIG. 6, there are provided a pair of grips 106*a* and 106*b* for allowing the grip and a pair of push-type control buttons 107*a* and 107*b* as a pair of controller adjacent to the grips 106*a* and 106*b* for allowing easy operation with the thumbs, respectively.

An indicator 108 for indicating remaining capacity of the battery 102 when the remaining capacity has decreased less than predetermined level and indicating the velocity of the hull 101 is provided at the upper surface of the front center of the hull 101. At the rear right and left portions of the hull 101, there are provided a pair of water outlets 109*a* and 109*b* of a pair of motor-driven pumps 110 which is described after, respectively.

Figure 3:
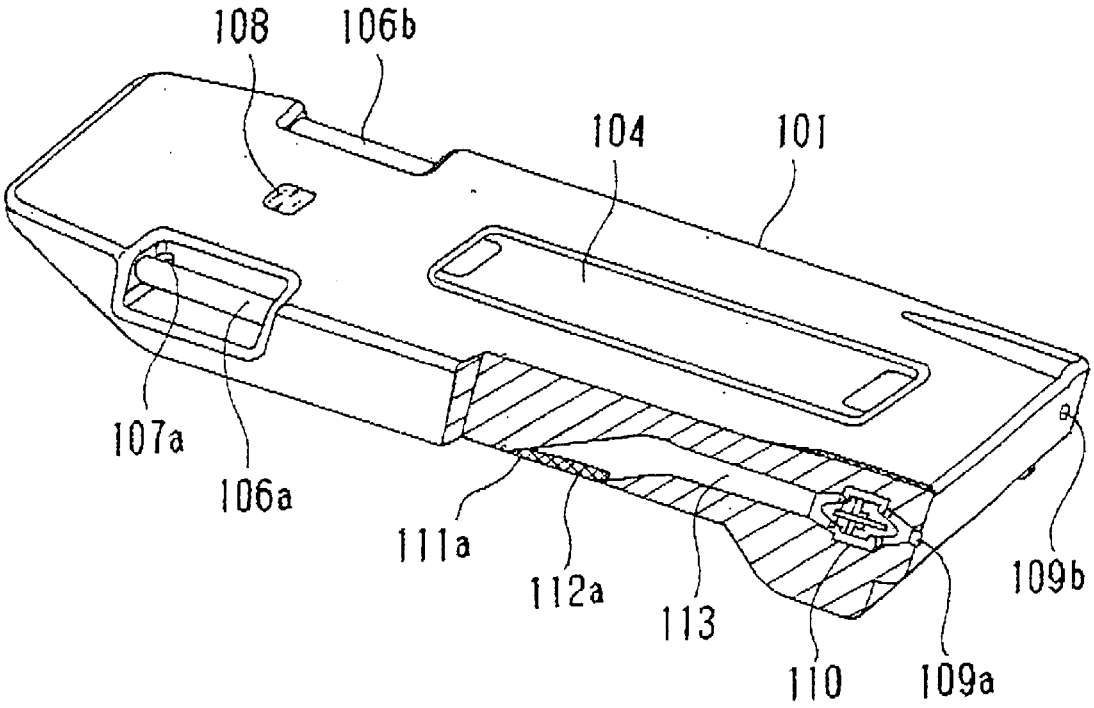
FIG. 3 is a perspective view, partially in broken away to show the arrangement of the motor-driven pump, of the swimming assistance apparatus according to the first embodiment of he present invention.
Figure 4:
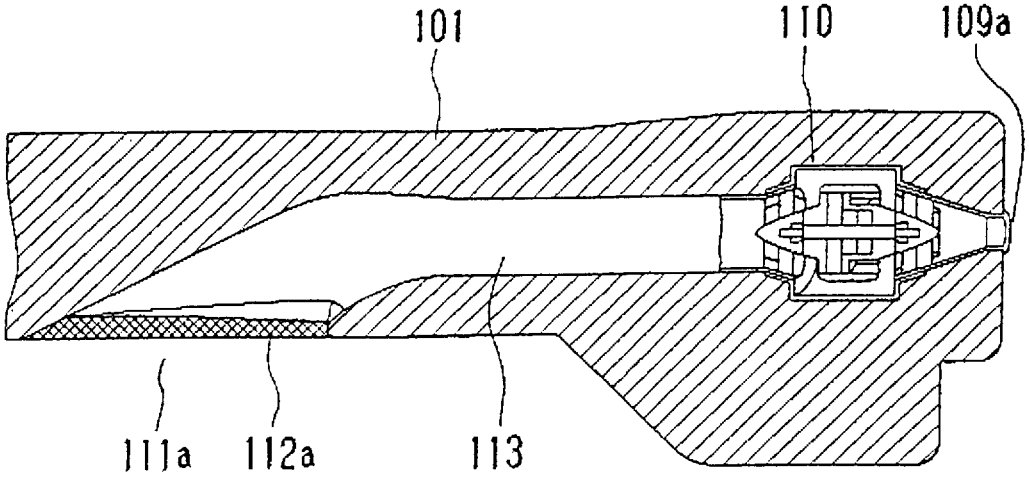
FIG. 4 is an enlarged vertical section view of the broken part of FIG. 3.

FIG. 3 is a perspective view, partially in broken away to show the arrangement of the motor-driven pump 110, of the swimming assistance apparatus according to the present invention. FIG. 4 is an enlarged vertical section view of the broken part of FIG. 3. The pair of motor-driven pumps 110 are provided at the rear right and left portions of inside of the hull 101. FIGS. 3 and 4 merely illustrates a motor-driven pump 110 arranged at right side.

Figure 5:
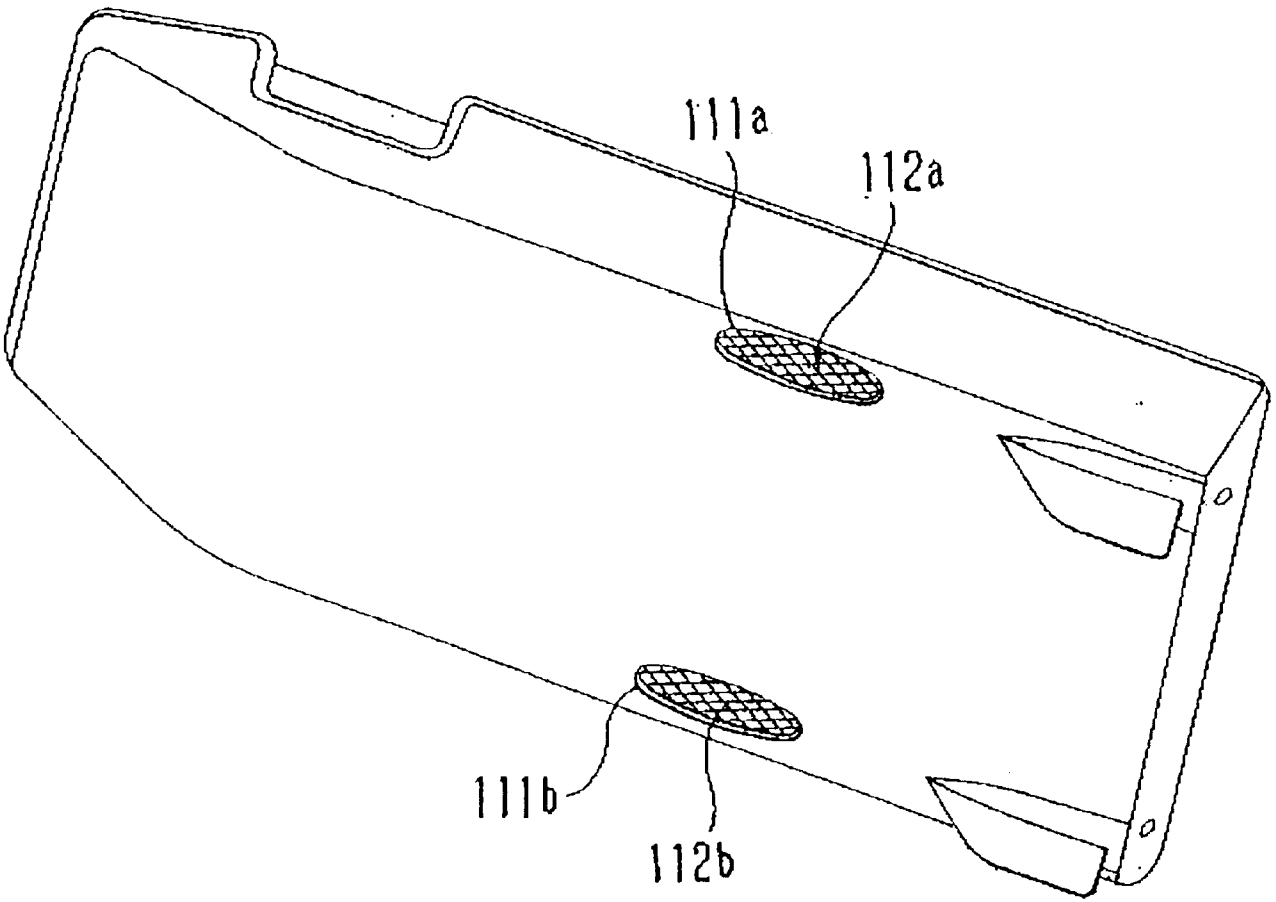
FIG. 5 is a perspective view illustrating the bottom portion of the swimming assistance apparatus according to the first embodiment of the present invention.
Figure 6:
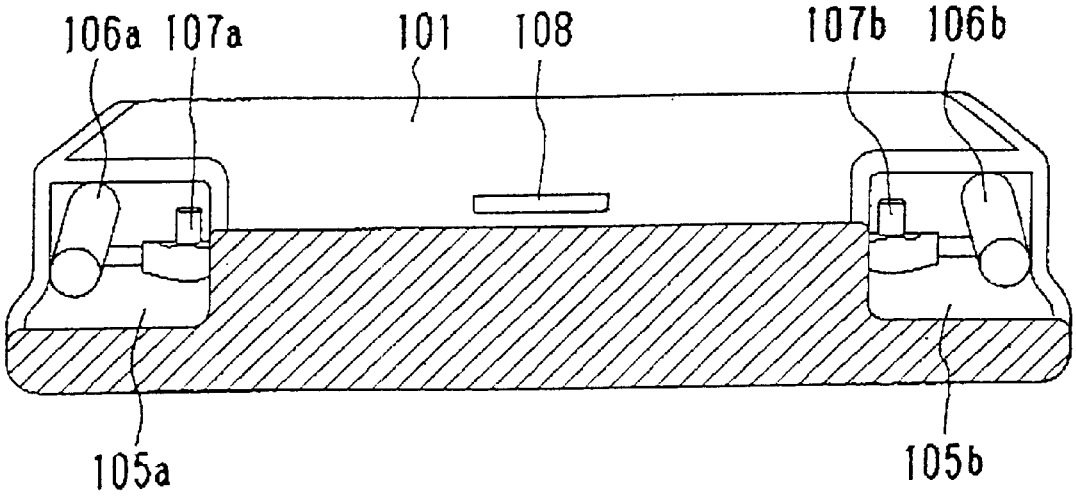
FIG. 6 is a sectional view taken substantially along the lines B—B of FIG. 1.

As shown in FIG. 5, a pair of water inlets 111*a* and 111*b* is provided at the bottom of the hull 101 so as to be disposed adjacent to the right and left portions with respect to the center of gravity of the hull 101, respectively. A pair of filters 112*a* and 112*b* for preventing inflow of foreign matters is attached to the pair of inlets 111*a* and 111*b*, respectively. The motor-driven pump 110 sucks water from the water inlet 111*a* via a guide channel 113, and will feed the sucked water into the water outlet 109*a*, so as to exhaust the water from the water outlet 109*a* via the motor-driven pump 110. Another motor-driven pump (not shown) sucks water from the water inlet 111*b*, and will feed the sucked water into the water outlet 109*b* so as to exhaust the water from the outlet 109*b* via the motor-driven pump (not shown). Thus, the water pressure occurs according to the water exhaust of each water outlet 109*a* and 109*b*, so that the hull 101 obtains driving power by the water pressure form the water outlets 109*a* and 109*b*.

Figure 7:
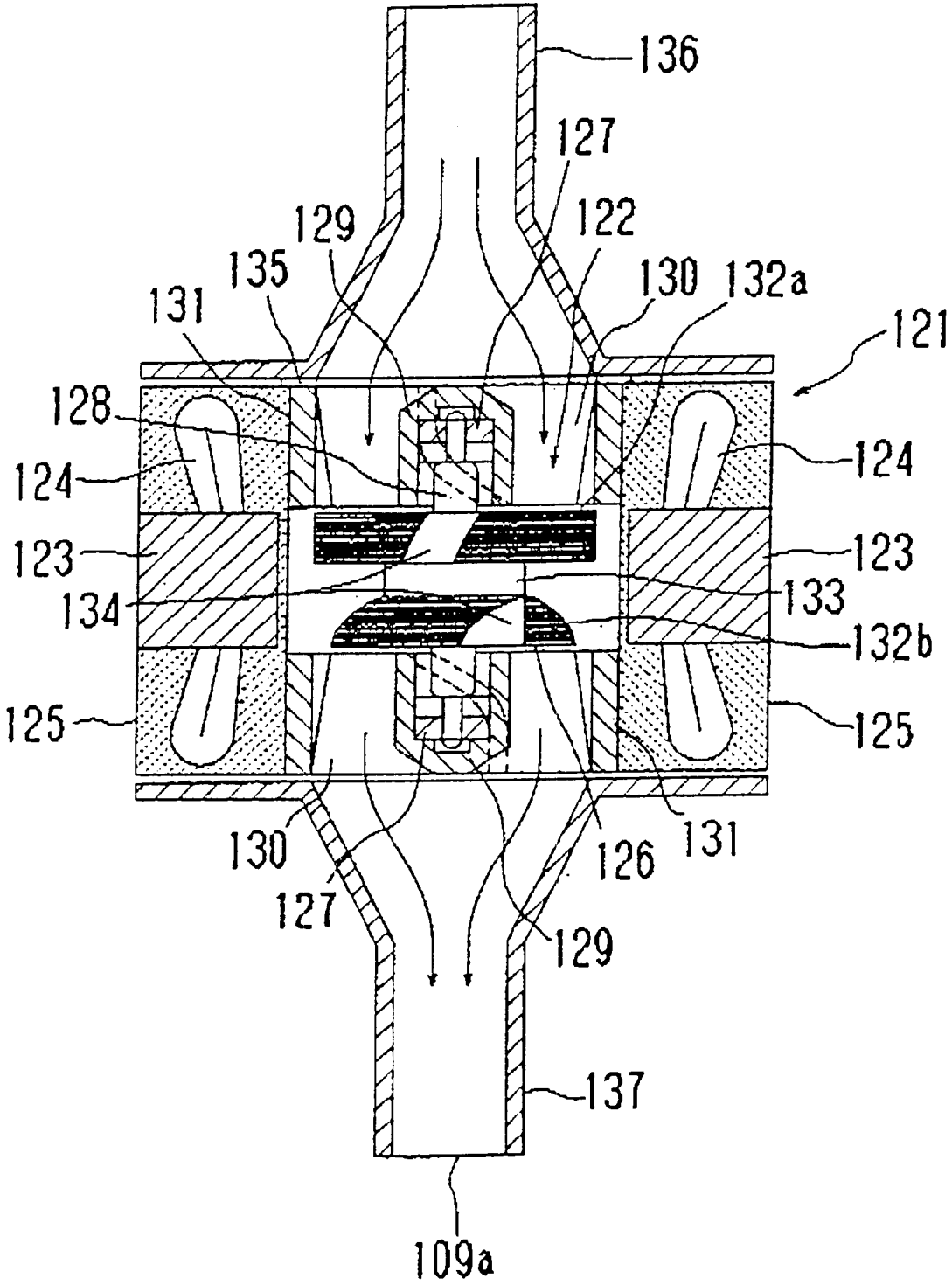
FIG. 7 is a vertical sectional view illustrating the structure of the motor-driven pump used for the swimming assistance apparatus according to the first embodiment of the present invention.

As shown in FIG. 7, the motor-driven pump 101 has a rotor assembly 122 rotatably in a ring-like stator assembly 121. The stator assembly 121 provides stator cores 123 having six magnetic poles with same forms in 60° pitch for instance respectively, and winds field coils 124 to each magnetic pole of the stator cores 123 in counterclockwise direction as A phase, B phase, C phase, A phase, B phase, and C phase in sequence. Each phase is wired with Y (wye) connection or delta connection, and three lead lines are wired. The whole inside peripheral portion and inside of the stator assembly 121 is molded with insulation resin 125 such as polyester for waterproofing. Each lead line is applied three phases alternative voltage with shifted phases in 120° so as to vary the rotating velocity by adjusting frequency of the applied voltage.

In the rotor assembly 122, a four salient polar structured rotor core 126 is fixed to a rotor axis 128, which is rotatably supported on a pair of sleeve bearing 127 formed out of the resin or the ceramics. Each sleeve bearing 127 is built into a pair of cap-like support members 129 respectively. Each support member 129 fixedly holds each sleeve bearing 127 respectively so as to allow insertion of each end of the rotor axis 128 to each sleeve bearing 127.

Each support member 129 fixedly supports four straightening plates 130 with even intervals in peripheral direction at its periphery. Each end part of straightening plate 130 is partially fixed to a pair of cylindrical members 131 pressed into the inner peripheral of the stator assembly 121. That is, each support member 129 is supported by each straightening plate 130 pressed into the inner periphery of the stator assembly 121.

The rotor core 126 uses four polar salient poled rotor comprises a pair of layer structured I-formed salient cores 123*a* and 132*b* piling up plural I-formed core materials with staggering each other, each I-formed salient core 123*a* and 132*b* is piled up via a permanent magnet 133 in cross form. Each periphery of the I-formed salient cores 123*a* and 132*b* forms a recess 134 penetrating in the axis direction of the rotor core 126 so as to form a channel with the inner periphery of the stator assembly 121.

The motor-driven pump 110 is manufactured as follows. The rotor assembly 122 is assembled into the stator assembly 121 while the pair of cylindrical members 131 supporting the pair of support members 129 with the pair of straightening plates 130 from both sides thereof. The end of each cylindrical member 131 is pressed with a water inlet guide 136 and a water outlet guide 137 formed out of thermoplastic resin via a seal 135 such as rubber seal. The water inlet guide 136 and the water outlet guide 137 are welded to the stator assembly 121, so that the motor-driven pump 110 is manufactured. The end of the water inlet guide 136 connects with the guide channel 113, the end of the water outlet guide 137 forms the water outlet 109*a*.

Another motor-driven pump (not shown) has same structure to the above motor-driven pump 110 whereby an end of a waver outlet guide (not shown) forms the water outlet 109*b*.

FIG. 8 is a circuit diagram for controlling the motor-driven pump 110 according to the present invention. The circuit provides a variable resistance 141, the resistance to which is variable according to press operation of the control button 107*a*, and a triangular wave generator 142 for generating triangular wave. The variable resistance 141 connects one end with the +12V terminal of the battery 102 and another end with the grounds. It is set that the control button 107*a* is pressed deeper, the voltage level of voltage signal $e_0$ will become lower and lower.

The voltage signal ea is input into a reverse input terminal (−) of the comparator 144 via a resistance 143, and the triangular wave voltage signal output from the triangular wave generator 142 is input into a non-reverse input terminal (+) of the comparator 144 via a resistance 145. The output from the comparator 144 is input into a base terminal of an npn transistor 147.

The npn transistor 147 connects its collector with the +12V terminal of the battery 102 via a resistance 147 and with an input terminal of a gate controller 148, and its emitter with the grounds. The gate controller 148 connects its output with a gate of a MOS-type FET 149. The motor-driven pump 110 is connected with a position between +12V terminal of the battery 102 and the grounds via the MOS-type FET 149. The gate controller 148 transmits high-level signal into the gate of the MOS-type FET 149 when the input signal thereof became 0V so as to make the MOS-type FET 149 active operation.

The structure for controlling one motor-driven pump 110 is described above, but a structure for controlling another motor-driven pump (not shown) has same structure of electric circuit.

In operation of the above swimming assistance apparatus is now described as follows. The swimming assistance apparatus is operated as Floating the hull 101 on the sea, river or the like, riding the upper half of the body on the hull 101 so as to lie on the stomach, gripping the each grips 106*a* and 106*b* with right and left hand, and pressing the control button 107*a* by the thumb. Then, the battery 102 begins power supply to the circuit, so that the voltage signal ea occurs in the variable resistance 141 and will be supplied to the comparator 144. The comparator 144 compares the voltage level of the voltage signal $e_0$ with the voltage level input from the triangular wave generator 142 so as to transmit high-level signal to the base of the transistor 146, when the voltage level of the voltage signal $e_0$ was lower than that of the triangular wave generator 142, to become the transistor 146 "ON".

The input voltage to the gate controller 148 becomes 0V when the transistor 146 was "ON", so that the gate controller 148 transmits high-level signal to the FET 149 to become the FET 149 "ON". The battery 102 connects with the motor-driven pump 110 so as to supply electric power to the motor-driven pump 110 when the FET 149 became "ON".

The motor-driven pump 110 supplied electric power drives the rotor core 126 to rotate while the motor-driven pump 110 excites the each phase of the coils of the stator core 123 in sequence. The axial fan formed by the recesses 134 of the rotor core 126 rotates with rotation of the rotor core 126 so as to suck the water from the water inlet 111*a* and flow the water into the motor-driven pump 110 via the guide channel 113.

In the motor-driven pump 110, as shown in FIG. 7 with arrows, the water flowed from the outer inlet guide 136 passes the each straightening plate 130 of inlet side, the recesses of the rotor core 126, the each straightening plate 130 of outlet side, and the water outlet 137 in order. The water flowed into the outlet 137 will be exhausted. strongly to the outside.

The same operations as above are executed in another motor-driven pump (not shown). That is, the motor-driven pump (not shown) begins to operate when the control button 107*b* was pressed, so that water sucked form the water inlet 111*b* passes the motor-driven pump (not shown) and will be exhausted strongly from the water outlet 109*b* to the outside.

As described above, the water is exhausted from the water outlet 109*a* or the water outlet 109*b*, so that the driving power to the hull 101 is generated to move forward the hull 101 on the water. The voltage level of the voltage signal $e_0$ is high such as voltage level $e_{01}$ shown in FIG. 9(A) when the control button 107*a* is pressed shallowly, so that the term, the voltage level from the triangular wave generator 142 of which becomes the level more than the voltage level $e_{01}$, is short, and then the output wave from the comparator 144 will become the signal such as a sequential signal with a pulse wave having narrow width in constant period as shown in FIG. 9(B). Accordingly, low electric power is supplied to the motor-driven pump 110, so that the motor-driven pump 110 drives with low rotation rate and then generates low driving power.

The voltage level of the voltage signal $e_0$ becomes lower such as voltage level $e_{02}$ shown in FIG. 9(A) with dotted line when the control button 107*a* is pressed deeper, so that the term, the voltage level from the triangular wave generator 142 of which becomes the-level more than the voltage level $e_{02}$, becomes longer, and then the output wave from the comparator 144 will become the signal such as a sequential signal with a pulse wave having wide width in constant period as shown in FIG. 9(C). Accordingly, high electric power is supplied to the motor-driven pump 110, so that the motor-driven pump 110 drives with high rotation rate and then generates high driving power.

As described above, variance of the pressing depths of the right and left control buttons 107*a* and 107*b* can control the pulse widths relating to the driving powers of the right and left motor-driven pumps respectively so as to control the driving powers of the right and left motor-driven pumps individually, so that velocity of the hull 101 and turn of the hull 101 can be controlled. Accordingly, anybody can use the swimming assistance apparatus according to the present invention easily without practice in the sea, river or the like. Thus, the swimming assistance apparatus according to the present has high utility for the recreation purpose or the sports purpose. Also, the size of the hull 101 requires only size, an operator of which can ride on the hull 101 with the upper half of the body, and a small and light weight motor-driven pump is used as a power source for generating driving power, so that a small sizing of the apparatus and an inexpensive to manufacture can be obtained.

The indicator 108 disposed-at the-upper surface of the front center portion of the hull 101 is faced to the eyes of the operator when the operator rode on the hull 101 with the upper half of his or her body so as to lie on the stomach. Accordingly, the velocity of the hull 101 can be easily confirmed with the indicator 108. The indicator 108 can also give a warning to the operator so as to easily confirm when the remaining capacity of the battery 102 became less than a predetermined level.

The battery 102 is disposed adjacent to the center of gravity of the hull 101, and the pair of water inlets 111*a* and 111*b* are provided at the bottom of the hull 101 so as to be disposed adjacent to the right and left portions with respect to the center of gravity of the hull 101, so that the center of gravity of the hull 101 moves backward only a little but the front of the hull 101 does not float when the weight is loaded at rear portion of the hull 101. Thus, the water can be always sucked from the water inlets 111*a* and 111*b* so as to generate the driving power surely.

The battery 102 is held in the hold 103 to cover with the lid 104. Thus, the upper surface of the hull 101 can be flat so as to prevent interference of the stomach to the battery chamber.

The filters 112*a* and 112*b* can protect the motor-driven pump 110 against inflow of the foreign matters from the water inlets 111*a* and 111*b*.

Any kinds of in-line type motor-driven pump P shown in FIGS. 23 to 32 can be used for the power source instead of the motor-driven pump 110 of the present embodiment.

A Second Embodiment of the Present Invention

A second embodiment of the present invention is now explained with reference to FIG. 10. The same parts as those in the first embodiment are designated by the same reference numerals, and are not again explained herein.

Figure 10:
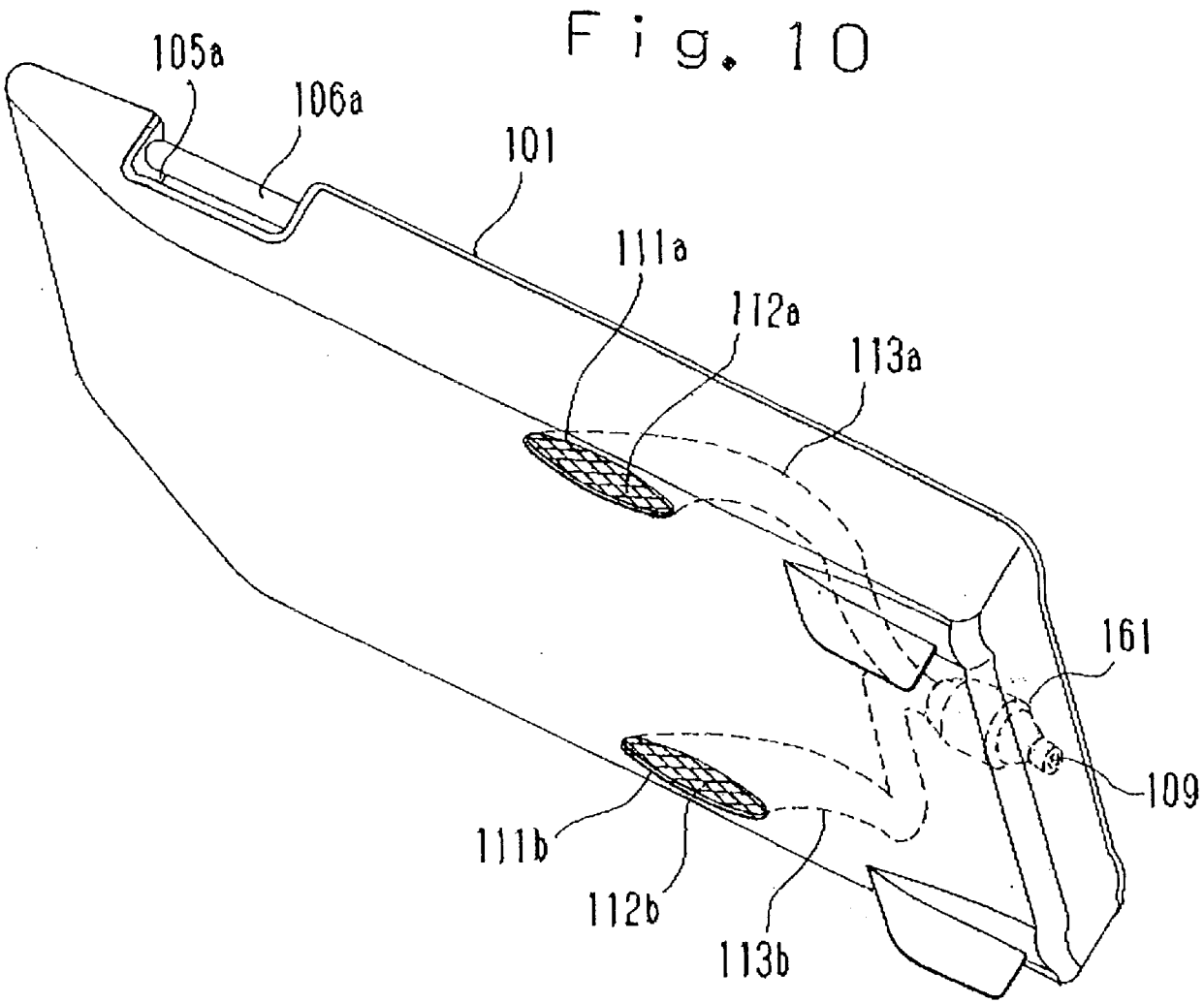
FIG. 10 is a perspective view illustrating the external appearance the swimming assistance apparatus according to a second embodiment of the present invention.

As shown in FIG. 10, a single motor-driven pump 161 is provided in the hull 101 at rear center. The swimming assistance apparatus has a structure which can supply the water sucked from the right and left water inlets 111*a* and 111*b* into the water inlet guide 136 of the motor-driven pump 110 via the guide channels 113*a* and 113*b*. The motor-driven pump 110 has a structure which can suck the water from the water inlet guide 136 by its rotation to pass inside thereof and can exhaust the water from the water outlet 109 to the outside. The driving circuit for driving and controlling the motor-driven pump 161 is same to the driving circuit for driving and controlling the motor-driven pump 110 of the first embodiment of the present invention. A single control button is provided adjacent to either right or left grips 105*a* and 105*b*. The structure and operation thereof is same to either the control button 107*a* or the control button 107*b* of the first embodiment of the present invention.

The motor-driven pump 161 is provided only one in this embodiment. Thus, right or left turn is performed using either weight shift in right or left direction or motion to right or left direction of lower half of the body or legs, or both these motions. Pressing depth of the control button controls the rotating rate of the motor-driven pump 161.

Accordingly, same function and same result to the first embodiment of the present invention is obtained in this embodiment.

In the former two embodiments, the motor-driven pump is driven to rotate one direction so as to suck the water from the water inlet and feed the water to the water outlet, but it is possible to drive the motor-driven pump to rotate reverse direction so as to suck the water from the water outlet and feed the water to the water inlet. In this case, hull 101 can be moved backward with position change of at least water inlet 111*a* and 111*b*.

Any kinds of in-line type motor-driven pump P shown in FIGS. 23 to 32 can be used for the power source instead of the motor-driven pump 161 of the present. embodiment.

A Third Embodiment of the Present Invention

A third embodiment of the present invention is now explained with reference to FIGS. 11 to 17.

Figure 11:
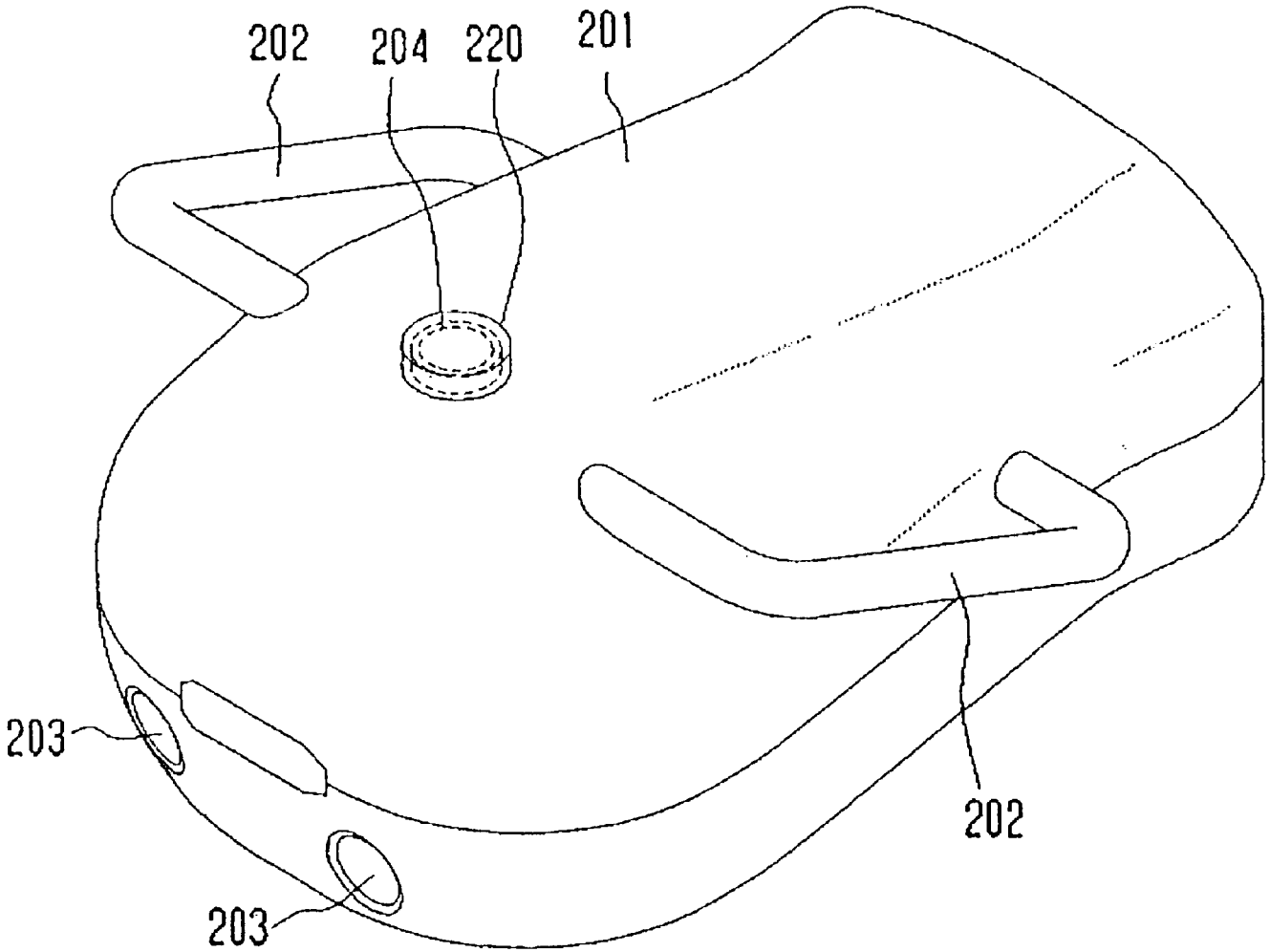
FIG. 11 is a perspective view illustrating the front external appearance of the swimming assistance apparatus according to a third embodiment of the present invention.

FIG. 11 is a perspective view illustrating the front external appearance of the swimming assistance apparatus according to the present invention. 201 designates to a base. The base 201 has a width in almost equal size to the breadth of the human's shoulder and a length in a size allowing the ride with the upper half of the body. A pair of handles 202 having right angle bent portion for grip is attached to the base 201 at right and left portions thereof. A pair of water inlets 203 is provided at the front right and left lower portions of the base 201. A water inlet-outlet 204 is also provided at upper surface of the base 201.

Figure 12:
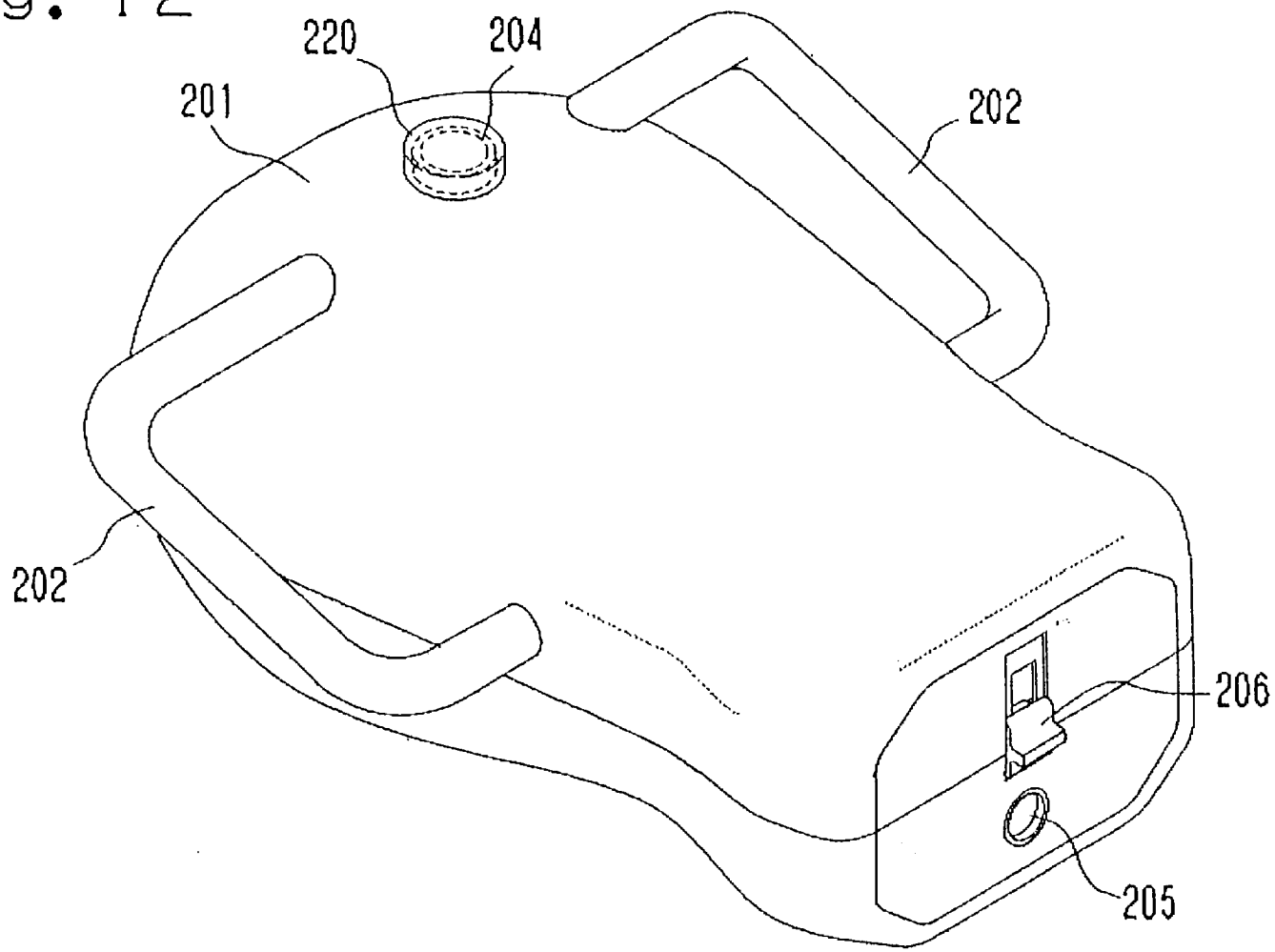
FIG. 12 is a perspective view illustrating the rear external appearance of the swimming assistance apparatus according to third embodiment of the present invention.

FIG. 12 is a-perspective view illustrating the rear external appearance of the swimming assistance apparatus according to the present invention. A water outlet 205 is provided at the rear lower portion of the base 201. An open-close switch 206 for opening and closing the water outlet 205 is also provided at the rear portion of the base 201 so as to be disposed above the water outlet 205. The open-close switch 206 comprises a valve 207 for moving up and down to open and close the water outlet 205, and a knob formed with the open-close switch 206.

Figure 13:
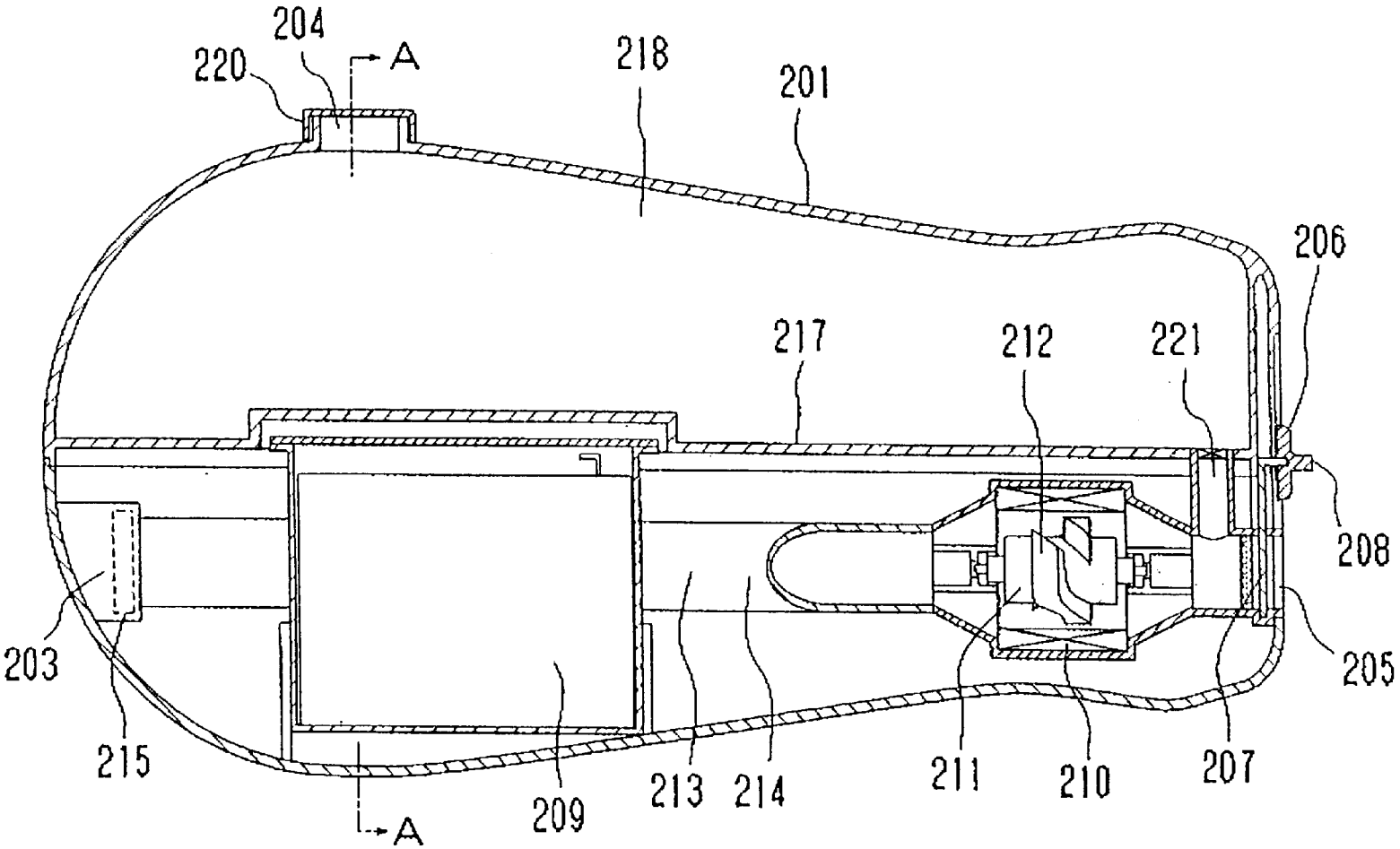
FIG. 13 is a sectional view illustrating the swimming assistance apparatus according to the third embodiment of t present invention.

FIG. 13 is a sectional view illustrating the swimming assistance apparatus according to the present invention. Inside of the base 201, there are provided a battery 209 at front lower portion of the base 201 and a motor-driven pump 212 formed by a motor 210 arranged in a pump chamber 211. The motor-driven pump 212 can be driven in the reverse direction as well as in the forward direction so as to reverse the water flow. The base 201 has a pair of spaces at both sides of the battery 209. A pair of suction pipes 213 for introducing the water from the water outlets 203 is provided at the space. These suction pipes 213 joins at upstream of the motor-driven pump 212. The motor-driven pump 212 connects the water outlet with the water outlet 205. Thus, a channel 214 for allowing water flow from water inlet 203 to the water outlet 205 is formed.

When the motor-driven pump 212 is driven so as to rotate in the forward direction, the water is sucked from the water inlet 203 via a front filter 215 provided at the water inlet 203 to pass the channel 213 and motor-driven pump 212, and the water will exhaust from the water outlet 205 to the outside via a rear filter 216 provided at water outlet of the motor-driven pump 212. The swimming assistance apparatus of the present embodiment obtains driving power by a reaction generated by exhaustion of the water from the water outlet 205. The motor 210 can be driven so as to rotate in the reverse direction by the operation of handle 205 as described after. Thus, the backward driving force can be obtained to flow the water from the water outlet 205 to the water inlet 203 by reverse rotation of the motor 210. This function is useful in case it has been necessary to stop immediately. Such case occurs when the operator find some obstacle in front of him or her.

Figure 14:
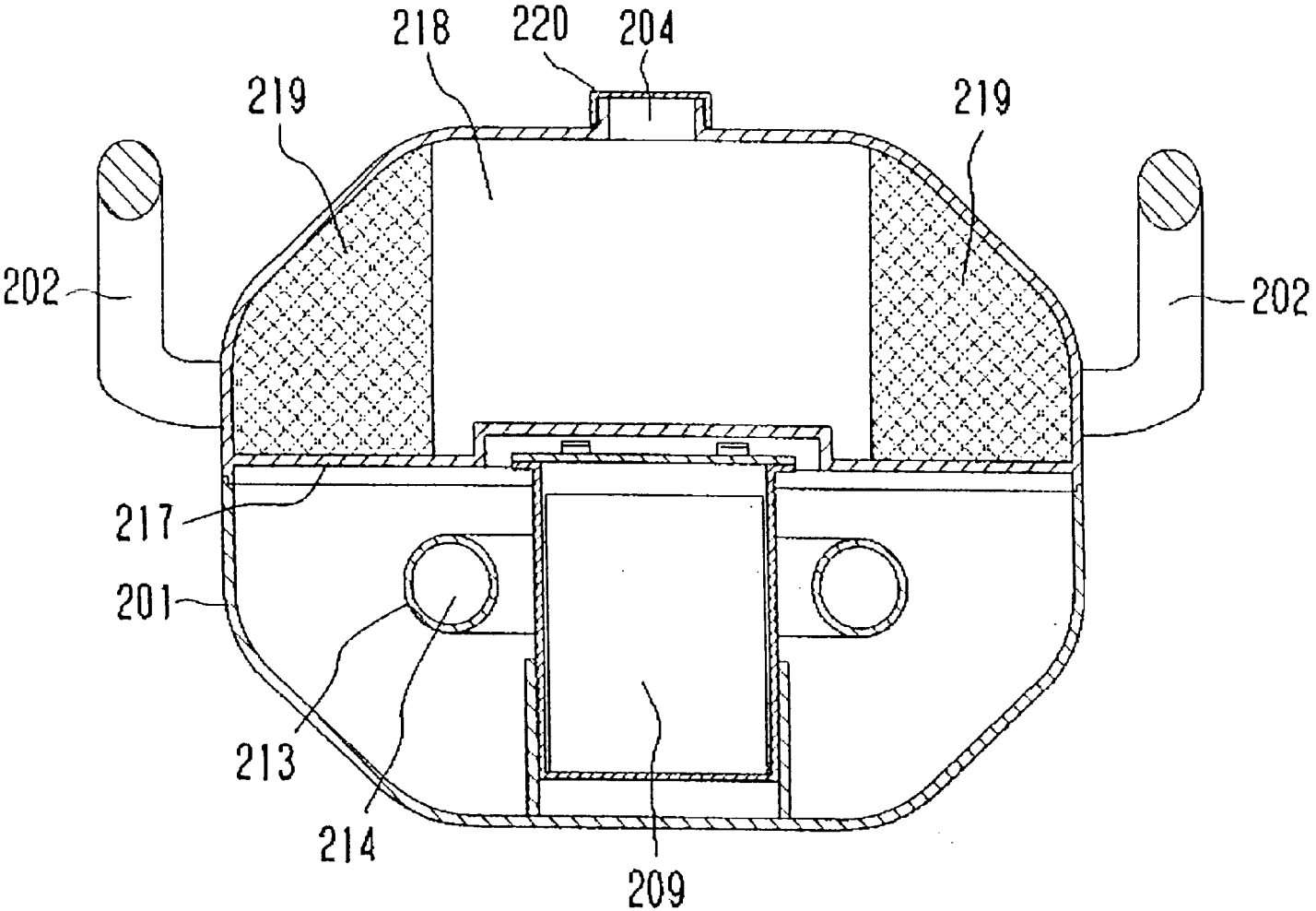
FIG. 14 is a vertical sectional view taken substantially along the lines A—A of FIG. 13.

The inside of the base 201 is divided by a separator 217 to dispose a buoyancy control chamber 218 at upper area of the base 201. FIG. 14 is a vertical sectional view taken substantially along the lines A—A of FIG. 13. In the base 201, there are provided a pair of expanded materials 219 at right and left sides on the separator 217, and an open space for forming the buoyancy control chamber 218 at center on the separator 217. The buoyancy of the base 201 is set little higher more than "0" so as to appear the upper portion partially with the water inlet-outlet 204 on the water in case the waver is filled full in the buoyancy control chamber 218. The buoyancy of the base 201 is set so that-the appearance specific-gravity of the base 201 becomes near 0.5 as a whole so as to appear the half of the base 201 on the water in case only air is filled in the buoyancy control chamber 218. The buoyancy of the base 201 can be adjusted between former two cases.

The water can be supplied into the buoyancy control chamber 218 by forward rotation of the motor-driven pump 212 while the open-close switch 206 shuts the water outlet 205. When the motor-driven pump 212 is driven to rotate in the forward direction, the water is sucked from the water outlet 205 into the buoyancy control chamber 218 via an inlet-outlet channel 221, so that the buoyancy control chamber 218 can be filled with water. The water can be drew from the buoyancy control chamber 218 by reverse rotation of the motor-driven pump 212 while the open-close switch 206 shuts the water outlet 205. When the motor-driven pump 212 is driven to rotate in the reverse direction, the water is exhausted to the outside via the inlet-outlet channel 221 and the water outlet 205, so that the water can be drew from the buoyancy control chamber 218.

Figure 15:
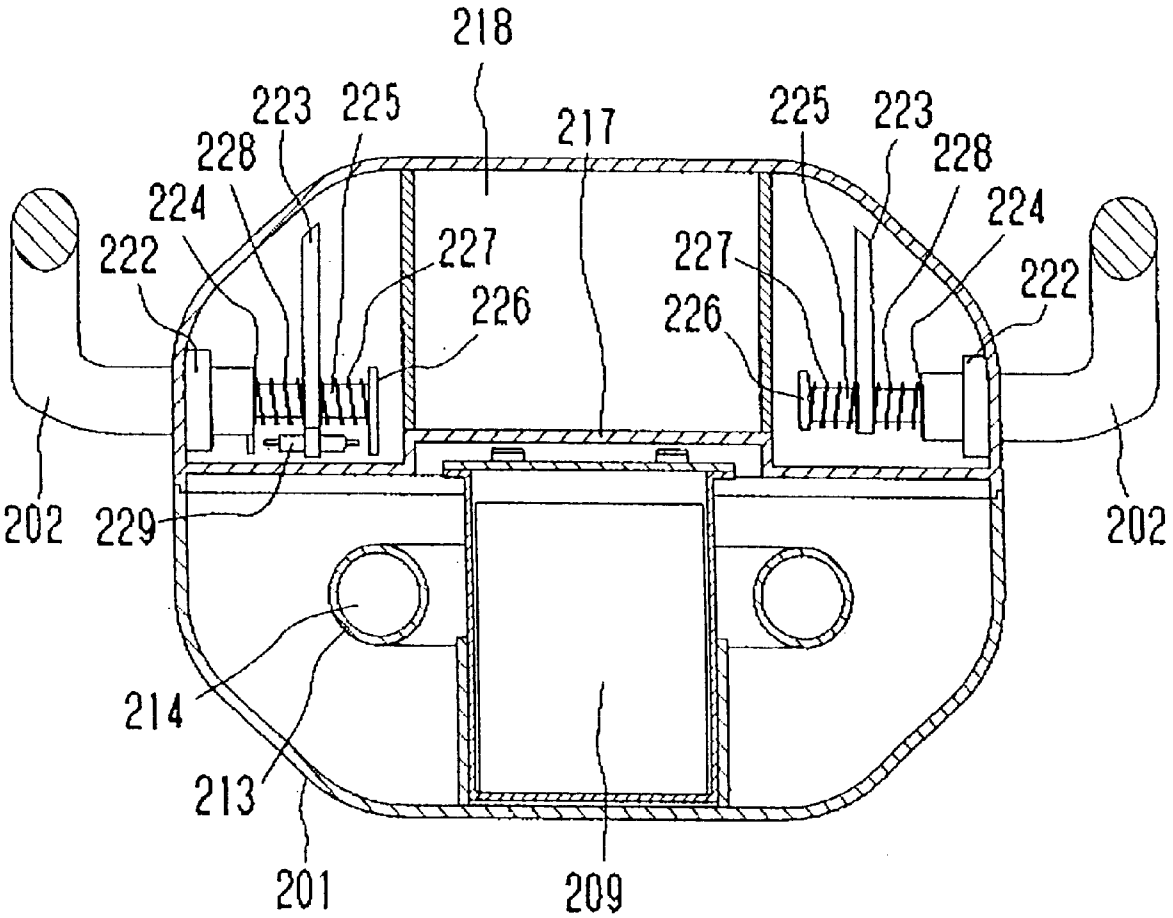
FIG. 15 is a vertical sectional view at the attaching portion the handle according to the third embodiment of the present invention.
Figure 16:
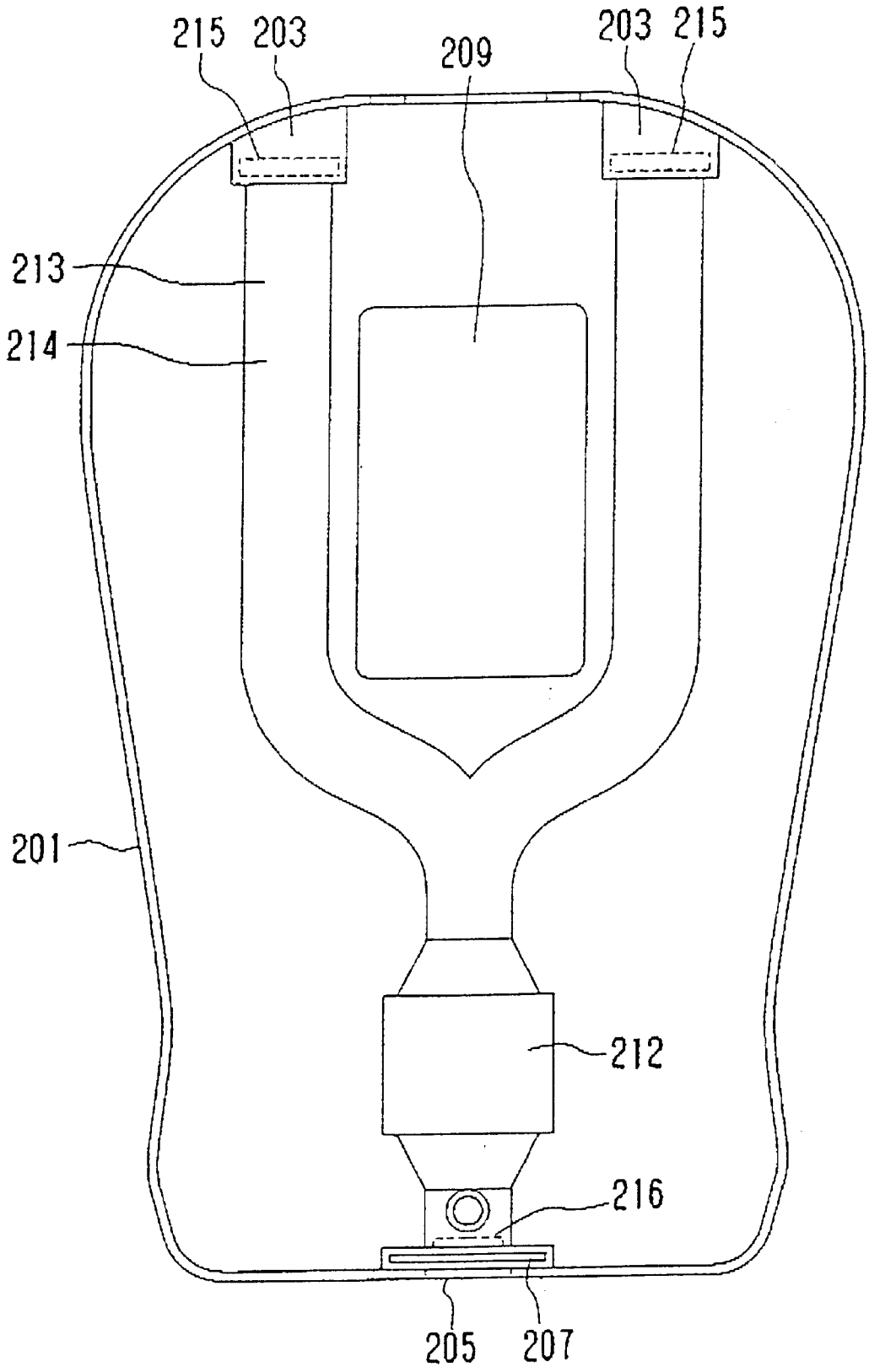
FIG. 16 is a horizontal sectional view illustrating the swimming assistance apparatus according to the third embodiment of the present invention.

FIG. 15 is a vertical sectional view at the attaching portion of the handle 202 to the base 201 according to the present invention. A supporting member 222 and a supporting plate 223 each provided in the base 201 supports right and left sides of the. handles 202. Each handle 202 is provided a step 224 to form a narrow portion 225 at one end. Each handle 202 is attached to the base 201 so as to insert the narrow portion 225 into the hole provided at the supporting plate 223. A flange 226 is attached to the end of each narrow portion 225 after insertion thereof. There are also provided a coil spring 227 between each step 224 and each supporting plate 223, and a coil spring 228 between each supporting plate 223 and each flange 226. Thus, the each handle 202 is attached to the base 201 rotatably so as to position in neutral.

When the operator operated to narrow the interval of each handle 202 griped with his or her hand, each flange 226 moves to the inner direction while the coil spring 227 between each step 224 and each supporting plate 223 is compressed. When the operator operated to expand the interval of each handle 202 griped with his or her hand, each flange 226 moves to the outer direction while the coil spring 227 between each supporting plate 223 and each flange 226 is compressed. That is, a displacement of the flange 226 occurs in each case. A detector 229 provided at one supporting plate 223 detects the displacement, which occurs in one flange 226. The detector 229 may comprise well-known optical detectors or magnetic detectors, or combination of well-known detectors. The swimming assistance apparatus of the present embodiment includes a rotation controller 230 shown in FIG. 17 for controlling the rotating rate of the motor 210 according to the detected signal of the detector 229. In the neutral position without any forces by the operator to the handles 202 shown in FIG. 15, the motor 210 is kept in static condition. In case the handles 202 are moved in the inner direction, displacement amount from the neutral position is larger, the rotating rate of the motor-driven pump 212 in the forward direction becomes higher and higher. In case the handles 202 are moved in the outer direction, displacement amount from the neutral position is larger, the rotating rate of the motor-driven pump 212 in the reverse direction becomes higher and higher.

Figure 17:
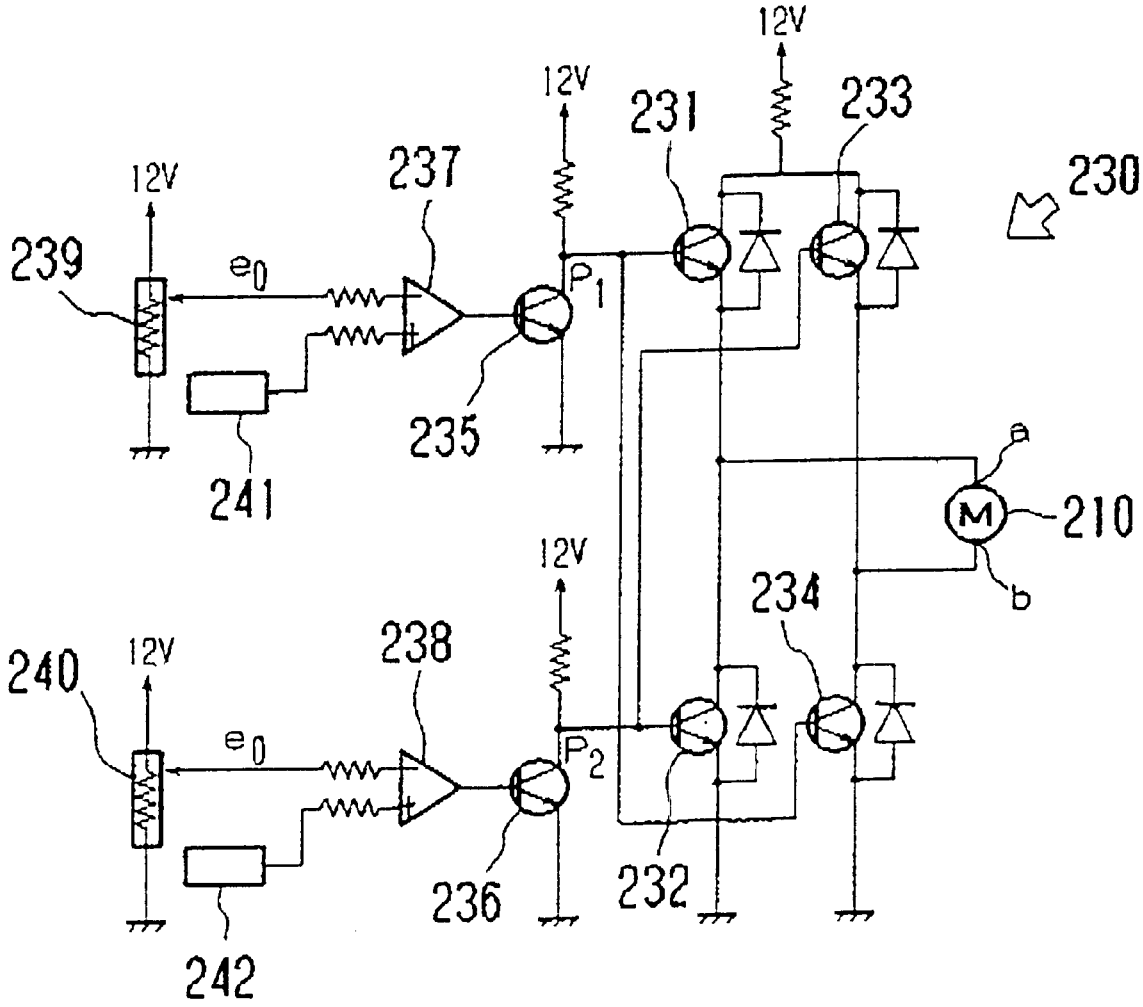
FIG. 17 is a circuit diagram for controlling the motor-driven pump according to the third embodiment of the present invention.

FIG. 17 is a circuit diagram of the rotation, controller 230 for controlling the motor-driven pump 212 according to the present invention. Four transistors 231, 232, 233 and 234 with serial connection are provided. The motor 210 connects its connect port "a" with a point between the transistor 231 and 232, and its connect port "b" with a point between the transistor 233 and 234. The transistors 231 and 233 connect their collectors with 12V power supply respectively. Transistors 235 and 236 are also provided to connect their collectors $P_1$ and $P_2$ with the base of the transistors 231 and 234 and the transistors 232 and 233 respectively. The transistors 235 and 236 connect their emitters with the grounds and their bases with the comparators 237 and 238 respectively. Variable resistances 239 and 240 connected with 12V power supply and triangular wave generators 241 and 242 are provided to connect with input of the comparators 237 and 238. The resistance value of the variable resistances 239 and 240 are adjusted so as to vary the resistance values according to the movement of the handles 202 in the inner or outer directions.

For riding the base 201, it is necessary to supply the water into the buoyancy control chamber 218 with suitable amount, to open the water outlet 205 with the open-close switch 206, to grip the handles 202, and to operate the handles 202. In case the handles 202 are operated to narrow, the base 201 goes forward. In case the handles 202 are tilted forward, the base 201 goes underwater. In case the handles 202 are tilted backward, the base 201 goes up on the water surface. The base 201 can turn in case one of the water inlets 203 is closed. In case the operator may turn loose the handles 203, the handles 203 will return to neutral positions so as to stop the motor 210, so that the base 201 can be floated on the water surface and easily recovered from underwater in safety. This is because the buoyancy of the base 201 is set little higher more than "0" even though the buoyancy control chamber 218 is filled with water. The base 201 can turn by forward and backward movements of the handles 202. In case the operator find some obstacle in front of him or her so that it is necessary to stop immediately, it is possible to stop by reverse rotation of the motor 210. The reverse rotation of the motor 210 is obtained by expanding the interval of each handle 202. Further, buoyant force of the base 201 can be controlled by adjusting the amount of water to be stored in the buoyancy control chamber 218, so that the operator can enjoy the driving while he or she rides the upper half of his or her body on the base 201 at water surface, or the operator can have a rest on the base 201 using buoyant force of the base 201.

The operation of rotation controller 230 for forward and backward moving of the base 201 is now described. In case of forward moving with forward rotation of the motor 210, movement of the handles 202 in the inner direction makes the variable resistance 239 to increase output voltage $e_0$ and makes the variable resistance 240 to decrease output voltage $e_0$. The comparator 237 compares the output voltage $e_0$ with the voltage from the triangular wave generators 241 so as to apply low voltage to the base of the transistors 235 when the output voltage $e_0$ was higher than the voltage from the triangular wave generators 241. Thus, the collector voltage $P_1$ of the transistor 235 becomes the voltage based on the 12V power supply, so that the transistors 231 and 234 become "ON". The comparator 238 compares the output voltage ea with the voltage from the triangular wave generators 242 so as to apply high voltage to the base of the transistors 236 when the output voltage $e_0$ was lower than the voltage from the triangular wave generators 242. Thus, the collector voltage $P_2$ of the transistor 236 becomes "0" voltage, so that the transistors 232 and 233 become "OFF". Thus, the electric current is turned on in the motor 210 from the connect point "a" to the connect point "b", so that the motor 210 is driven to rotate in the forward direction.

In case of backward moving with reverse rotation of the motor 210, movement of the handles 202 in the outer direction makes the variable resistance 240 to increase output voltage $e_0$ and makes the variable resistance 239 to decrease output voltage $e_0$.The comparator 238 compares the output voltage $e_0$ with the voltage from the triangular wave generators 242 so as to apply low voltage to the base of the transistors 235 when the output voltage ea was higher than the voltage from the triangular wave generators 242. Thus, the collector voltage $P_2$ of the transistor 236 becomes the voltage based on the 12V power supply, so that the transistors 232 and 233 become "ON". The comparator 237 compares the output voltage $e_0$ with the voltage from the triangular wave generators 241 so as to apply high voltage to the base of the transistors 235 when the output voltage $e_0$ was lower than the voltage from the triangular wave generators 241. Thus, the collector voltage $P_1$ of the transistor 235 becomes "0" voltage, so that the transistors 231 and 234 become "OFF". Thus, the electric current is turned on in the motor 210 from the connect point "b" to the connect point "a", so that the motor 210 is driven to rotate in the reverse direction.

Any kinds of in-line type motor-driven pump P shown in FIGS. 23 to 32 can be used for the power source instead of the motor-driven pump 110 of the present embodiment.

A Fourth Embodiment of the Present Invention

Figure 18:
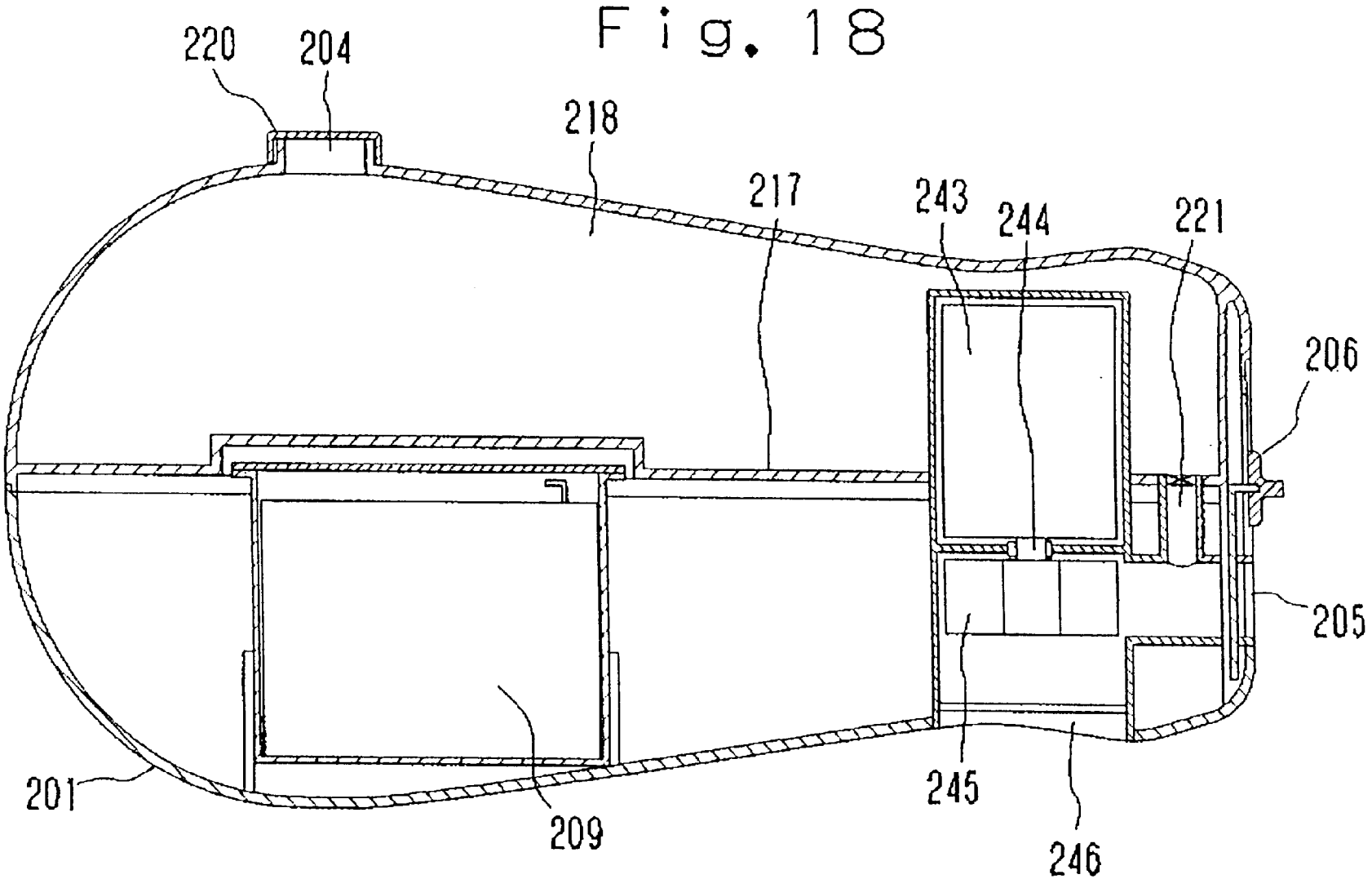
FIG. 18 is a vertical sectional view illustrating the swimming assistance apparatus according to a fourth embodiment of the sent invention.

A fourth embodiment of the present invention is now explained with reference to FIG. 18. The same parts as those in the third embodiment are designated by the same reference numerals, and are not again explained herein.

The motor-driven pump of the present invention is ordinary motor-driven pump which is driven to rotate in one direction. A motor 243 provides a centrifugal fan 245 at its rotary axis 244. There are provided a water inlet opening 246 under the centrifugal fan 245 and a water outlet 205 at the rear portion of the base 201.

In operation, driven motor 243 occurs pulling force into underwater to the rear portion of the base 201. Thus, the rising and lowering movement occurs in the base 201, so that the operator can enjoy the movement.

A Fifth Embodiment of the Present Invention

Figure 19:
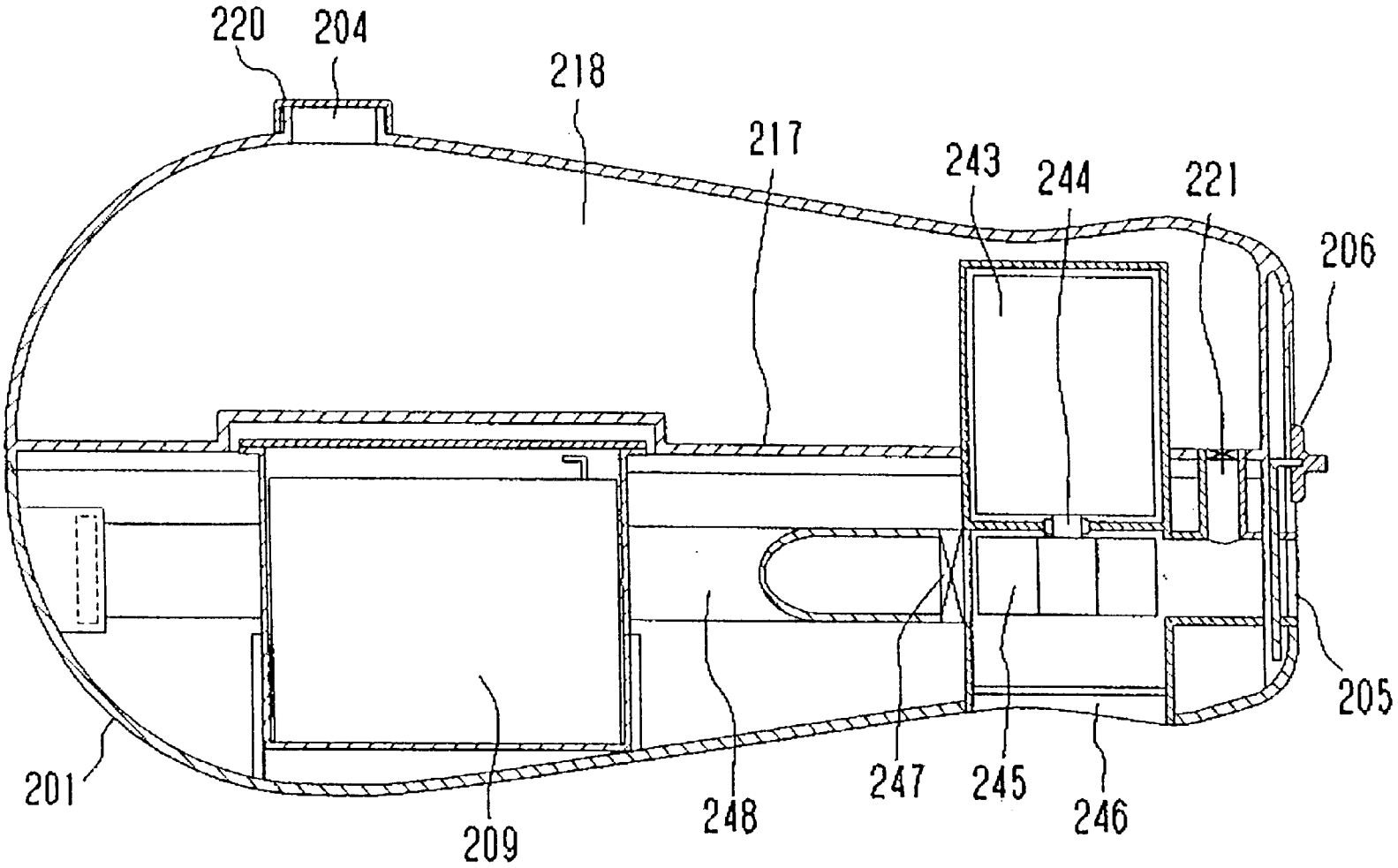
FIG. 19 is a vertical sectional view illustrating the swimming assistance apparatus according to a fifth embodiment of the present invention.

A fifth embodiment of the present invention is now explained with reference to FIG. 19. The same parts as those in the third and fourth embodiments are designated by the same reference numerals, and are not again explained herein.

There is provided a pipework 248, one end of which connects with the front lower portion of the base 201 and another end of which connects with the water inlet opening 246 via a valve 247, in the lower area of the base 201. FIG. 19 shows a state that the water outlet 205 is shut with the open-close switch 206 so as to prevent the water flow from the water inlet opening 246 to the water outlet 205. In this state, the water from the water inlet opening 246 is led to the water inlet 203 so as to exhaust the water from the water inlet 203, so that the brake function to the base 201 is obtained.

A Sixth Embodiment of the Present Invention

A sixth embodiment of the present invention is now explained with reference to FIGS. 20 to 22.

Figure 20:
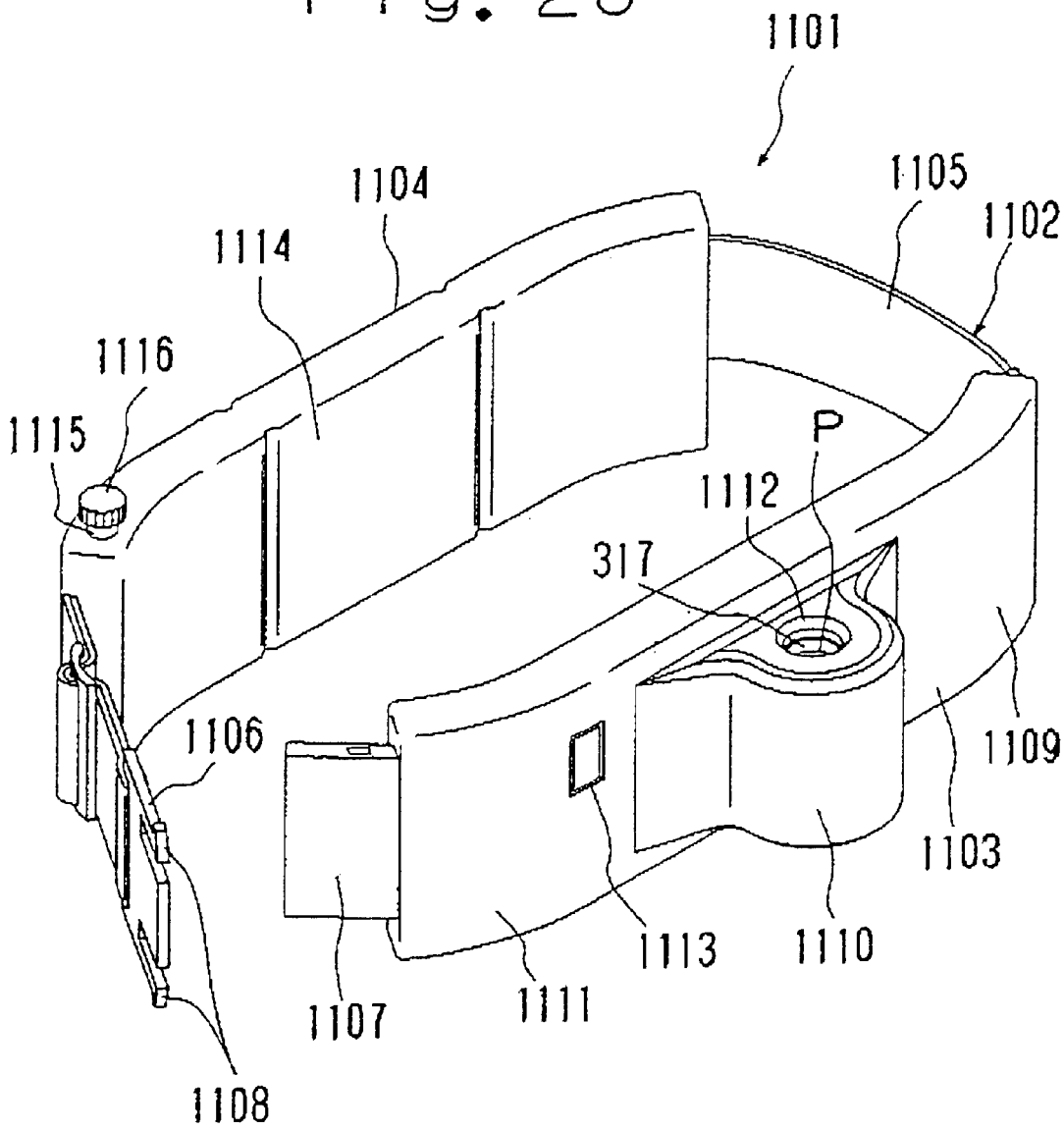
FIG. 20 is a perspective view illustrating the external appearance of the swimming assistance apparatus according to a sixth embodiment of the present invention.

FIG. 20 is a perspective view illustrating the external appearance of the swimming assistance apparatus 1101 according to the present invention. The swimming assistance apparatus comprises a belt 1102 as a base for attaching to the trunk of the human body, an in-line type motor-driven pump P as a motor-driven pump, driving circuit (not shown), a power source chamber 1103 for storing the power source (battery: not shown) of the motor-driven pump P with watertight, and an optional function adding mechanism 1104.

The belt 1102 has a belt member 1105, which is suitable for banding the trunk of the human body, one end of which has a hook 1106 and another end of which has a catcher 1107. The hook 1106 has a pair of elastic hook members 1108, which is able to deform and restore in belt-width direction. The catcher 1107 can detachably catch the hook members 1108.

There is provided a casing 1109 to house the in-line type motor-driven pump P, the driving circuit, and the battery (not shown). The casing 1109 provides a motor-driven pump chamber 1110 for housing the in-line type motor-driven pump P, a circuit chamber 1111 for housing driving circuit with-watertight, and the power source chamber 1103. The motor-driven pump chamber 1110 is formed so as to protrude from other portions. The casing 1109 has a form, the inner side of which is fit to the stomach. That is, casing 1109 is provided on the belt member 1105 so as to be positioned at the stomach while the belt member 1105 is attached to the trunk of the human body.

As shown in 20, the motor-driven pump P has a water inlet hole 1112 at one side in belt-width direction, and a water outlet hole (not shown) at another side in belt-width direction. These water inlet hole 1112 and water outlet hole correspond to a water inlet 317 and a water outlet 319 each provided in the in-line type motor-driven pump P. At the circuit chamber 1111 there is provided a power switch 1113 for controlling the power supply from the battery to the driving circuit and the in-line type motor-driven pump P.

The optional function adding mechanism 1104 is detachably attached to the belt member 1105. The optional function adding mechanism 1104 has a fluid chamber 1114 for storing fluid such as water, air, particle or the like. The fluid chamber 1114 has an inlet-outlet 1115 connecting the inside of the fluid chamber 1114 with outside. A valve 1116 is detachably attached to the inlet-outlet 1115 of the fluid chamber 1114 so as to seal the inside of the fluid chamber 1114. Accordingly, fluid such as water, air, particle or the like can be inserted into the fluid chamber 1114 from the inlet-outlet 1115 so as to house in the fluid chamber 1114 with watertight if necessary.

Any kinds of in-line type motor-driven pump P shown in FIGS. 23 to 32 can be used for the in-line type motor-driven pump P of the present embodiment. The detailed description thereof will be described after.

Figure 21:
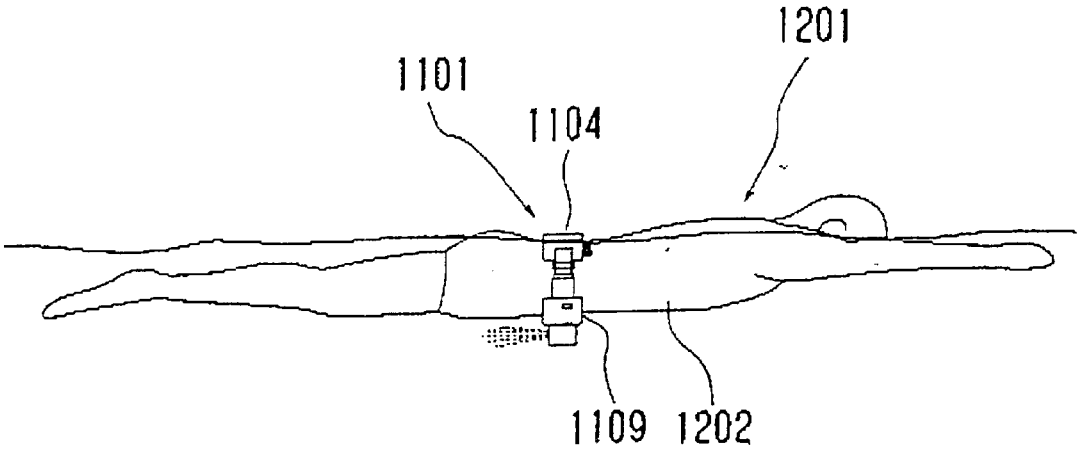
FIG. 21 is a side view illustrating actual use of the swimming assistance apparatus in the water surface according to the present invention.
Figure 22:
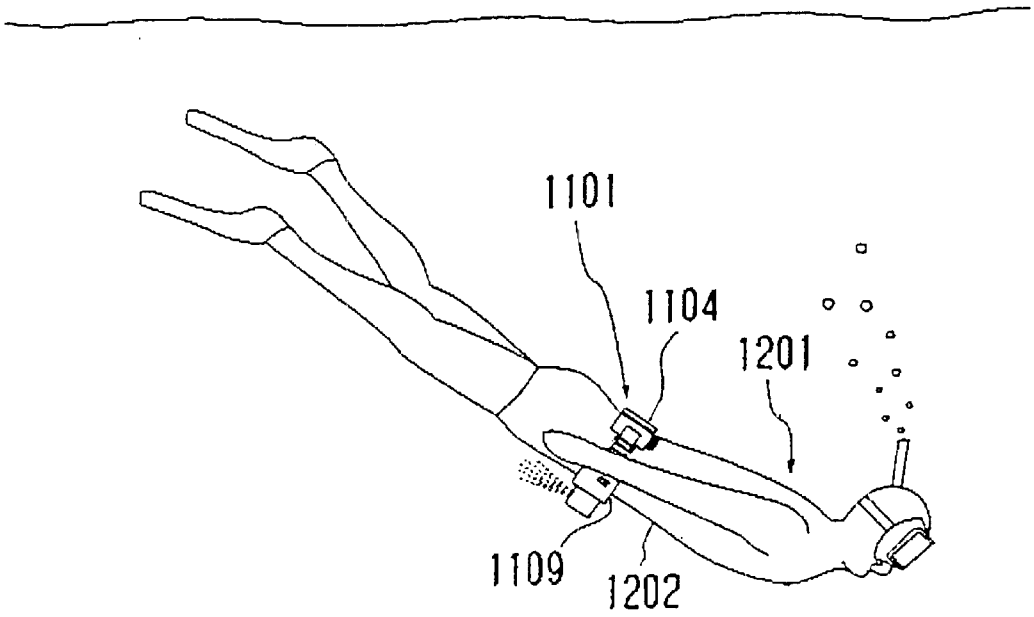
FIG. 22 is a side view illustrating actual use of the swimming assistance apparatus underwater according to the present invention.

In operation, as shown in FIGS. 21 and 22, the belt member 1105 banded to the trunk can be easily attached to the human body 1201 by catching the hook 1106 with the catcher 1107. In the water, the in-line type motor-driven pump P begins to drive after switching with the power switch 1113.

Because following description for the operation of the swimming apparatus 1101 of the present embodiment includes description with respect to the in-line type motor-driven pump P, it is preferable to read following description with respect to the in-line type motor-driven pump P in advance.

In the water, the motor-driven pump P sucks the water form the water inlet 317. A straightening plate 316 formed at an inner space 315 of a flange 312 straightens the water sucked from the water inlet 317. The water is fed with pressure by an axial fan 308 into a water outlet 319 to exhaust. Thus, the in-line type motor-driven pump P operates so as to arise function thereof. Then, the driving power occurs in the in-line type motor-driven pump P that is arranged at stomach 1202, so that swimming movement is assisted.

Because the swimming assistance apparatus 1101 of the present invention is attached to the trunk, i.e., stomach 1202, body movement for swimming such as an arm movement, a leg movement, a waist movement or the like is not prevented. Especially, the in-line type motor-driven pump P used in the present invention has high efficiency. As compared with prior in-line type motor-driven pump, the in-line type motor-driven pump P can be small sizing around ⅓ to ⅕ in order to obtain same power to the prior one. This is another reason that the body movement for swimming such as an arm movement, a leg movement, a waist movement or the like is not prevented. The swimming assistance apparatus 1101 does not has buoyancy if the air something like that is not supplied into the fluid chamber 1114 of the optional function adding mechanism 1104, so that the swimming assistance apparatus 1101 can be used underwater as well as on the water surface. That is, the swimming assistance apparatus 1101 gives assistance for swimming not only on the water surface as shown in FIG. 21 but also under water as shown in FIG. 22.

In case the fluid chamber 1114 of the optional function adding mechanism 1104 is filled with air, the swimming assistance apparatus 1101 has buoyancy. Thus, the fluid chamber 1114 filled with air gives the swimming assistance apparatus 1101 safety and fun for the beginners of swimming such as children or people who is weak such as old people.

In case the fluid chamber 1114 of the optional function adding mechanism 1104 is filled with water, sand or the like, the swimming assistance apparatus 1101 sink underwater. Thus, is can be used for swimming underwater as shown in FIG. 22.

As mentioned above, the swimming assistance apparatus 1101 of the present invention can be used for various purposes such as the purpose for making beginners familiar with water, the purpose for practice of swimming, the purpose for marine sports like skin diving, the purpose for scuba diving or the like.

The swimming assistance apparatus 1101 may be attached to the breast. The in-line type motor-driven pump P may be attached at the back. Suitable structure for above cases can be easily designed.

In-line Type Motor-driven Pumps P

Some kinds of in-line type motor-driven pumps P which are suitable for using the swimming assistance apparatus according to the present invention is now explained with reference to FIGS. 23 to 32.

Figure 23:
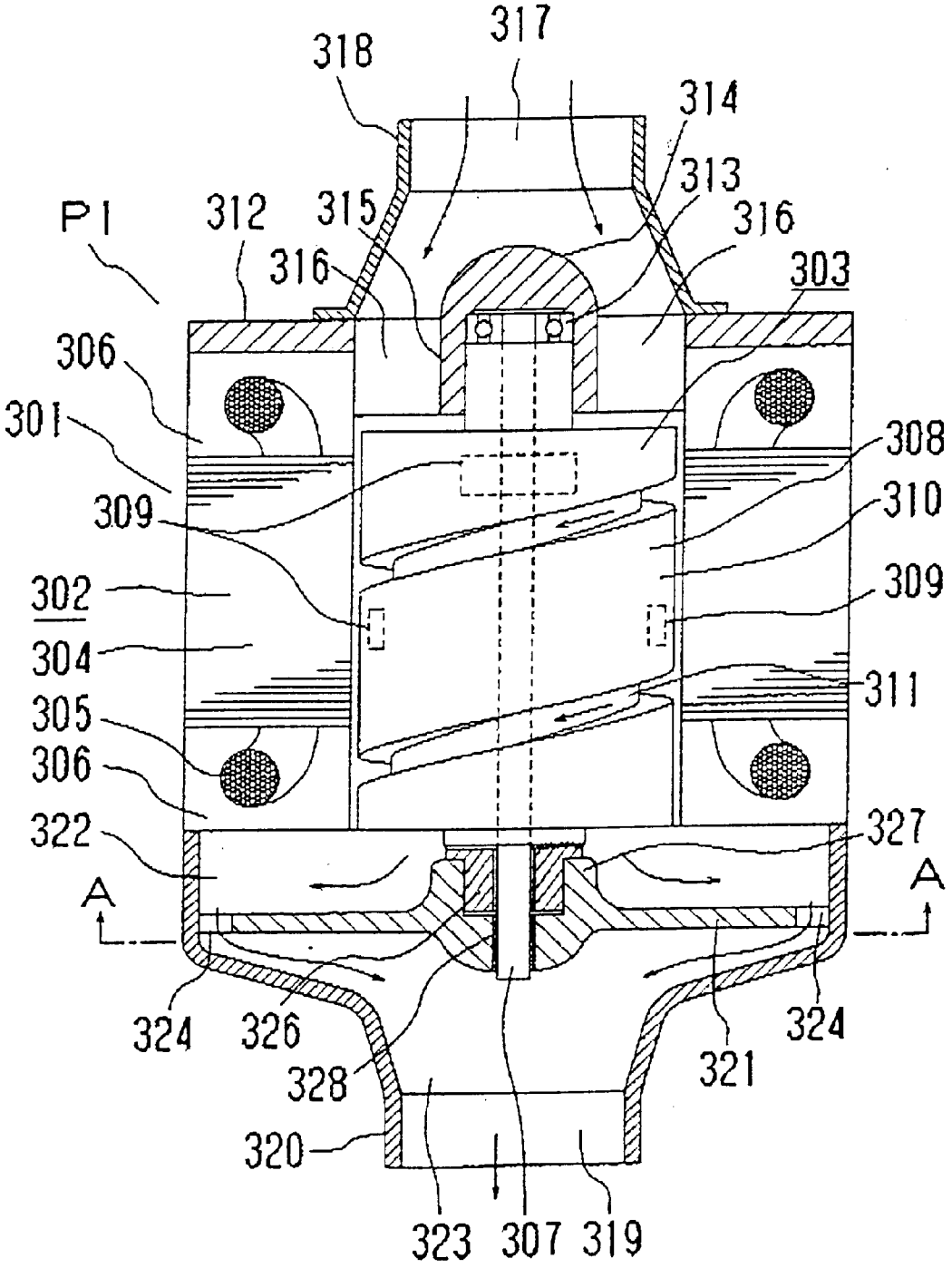
FIG. 23 is a vertical sectional view illustrating the structure of the motor-driven pump used for the swimming assistance apparatus according to the present invention.
Figure 24:
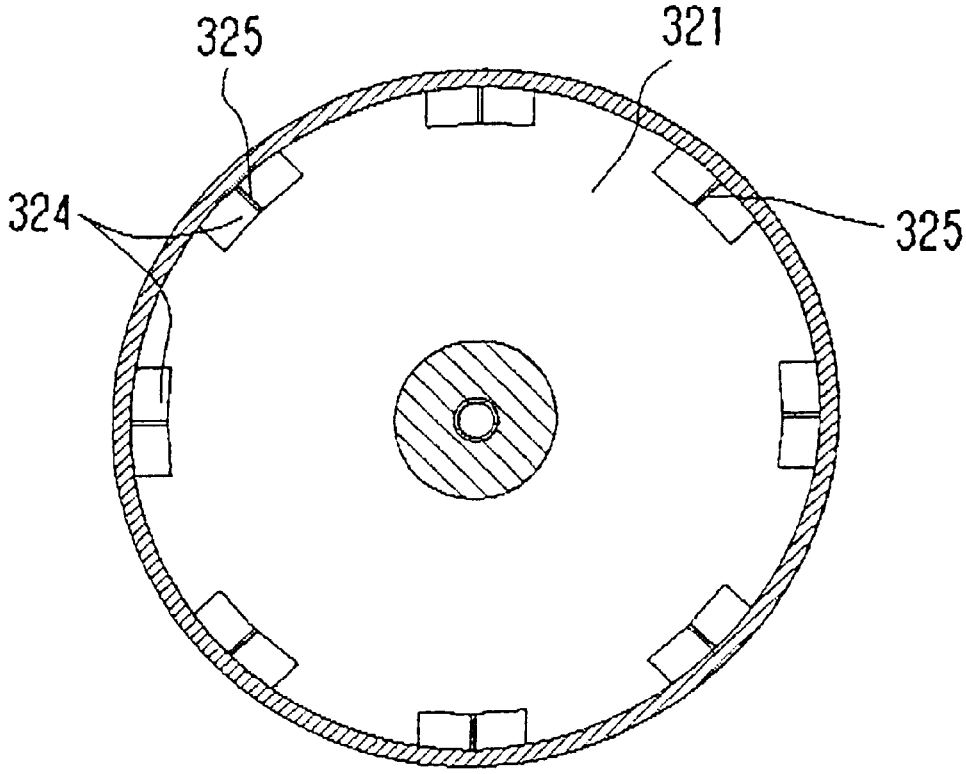
FIG. 24 is a sectional view taken substantially along the lines A—A of FIG. 21.
Figure 25:
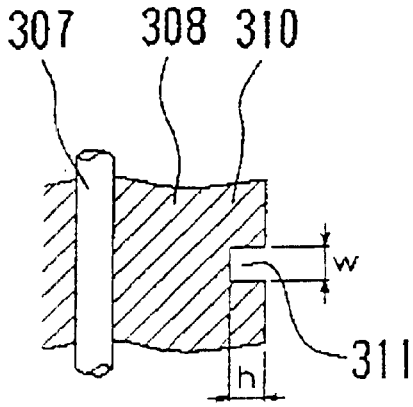
FIG. 25 is a vertical sectional view illustrating a portion of the rotor according to the present invention.

An embodiment of the in-line type motor-driven pumps P is now explained with reference to FIGS. 23 to 25. FIG. 23 is a vertical sectional view illustrating the structure of the motor-driven pump P according to the present invention. FIG. 24 is a sectional view taken substantially along the lines A—A of FIG. 21. FIG. 25 is a vertical sectional view illustrating a portion of the rotor 303 according to the present invention.

In FIG. 23, 301 designates to a motor. The motor 301 comprises a cylindrical stator 302 and the rotor 303. The stator 302 includes a stator core 304 formed by layer of plural cylindrical iron plates, plural coils 305 wound around the stator core 304, and resin layer 306 covering the coils 305 and the end faces of the stator core 304.

The rotor 303 includes an axial fan 308 having a rotary shaft 307 fixedly at center portion thereof, and plural magnetic poles 309 at inside. The axial fan 308 comprises a pillar 310 and a spiral groove 311 formed on the periphery of the pillar 310. As shown in FIG. 25, the width "w" and the depth "h" of the spiral groove 311 is determined almost equal size.

A flange 312 is fixed to the end of the stator 302. The flange 312 has a dome-like support 314 for supporting a bearing 313, and an open space 315 for opening around the support 314. Plural straightening plates 316 are formed in the open space 315 in radial.

A water inlet member 318 having the water inlet 317 for introducing water is fixed to the surface of the flange 312. There is provided a cup-like water outlet member 320 having the water outlet 319 at another end of the stator 302. A separator 321 is provided in the water outlet member 320. The separator 321 is formed with the water outlet member 320 in the same time. The separator 321 may be provided as individual member to the water outlet member 320 so as to attach to the water outlet member 320. A first pressure chamber 322 is provided at a portion between the separator 321 and the end of stator 302 and rotor 303. A second pressure chamber 323 is provided at a portion between the separator 321 and the water outlet 319. There are provided plural guide holes 324 at periphery of the separator 321 to connect the first pressure chamber 322 with the second pressure chamber 323. Each guide hole 324 has a rib 325 at center as shown in FIG. 24. These ribs 325 inclines to the rotary shaft 307 of the axial fan 308 so as to straighten the water flow with turning in axial direction.

As shown in FIG. 23, the separator 321 provides a bearing support 327 for supporting a periphery of a thrust bearing 326, and a leakage channel 328 for connecting the second pressure chamber 323 and inner periphery of the thrust bearing 326.

The rotary axis 307 of the rotor 303 is rotatably supported with the bearing 313 and the thrust bearing 326. A recess formed in the axial fan 308, the radius on the axis (rotary center) of the rotor 303 of which is minimum (this means the spiral groove 311) has diameter larger than that of the bearing support 327.

In operation, when the electric current was applied to the motor 301, the motor 301 is driven to rotate the rotor 303 having the axial fan 308. Thus, water is sucked from the water inlet 317, is straighten by the straightening plate 316 formed at the inner space 315 of the flange 312, is fed with pressure to the first pressure chamber 322 by rotation of the axial fan 308, and is exhausted from the water outlet 319 via the guide holes 324 and the second pressure chamber 323. The axial fan 308 feeds water by rotation thereof, so that rotation kinetic energy is generated at output of the axial fan 308. The first pressure chamber 322 transforms the rotation kinetic energy to static pressure energy so as to exhaust the water from the water outlet 319 in efficiency.

That is, rotating rate of the water discharged from the spiral groove 311 of the axial fan 308 becomes lower and lower as the radius on the axis of the axial fan 308 is lager. Then the difference of the velocity of the kinetic energy transforms the pressure.

The in-line type motor-driven pump P provides a thrust bearing 326 for rotatably supporting the rotary shaft 307 of the rotor 303 at the center of the separator 321, which provides the leakage channel 328 for connects the inner periphery of the thrust bearing 326 and the second pressure chamber 323, so that water stored in the second pressure chamber 323 is supplied in the position between the axis 307 of the rotor 303 and the thrust bearing 326 with constant pressure distribution. Thus, the rotary shaft 307 is lubricated well for along time.

The recess formed in the axial fan 308, the radius on the axis (rotary center) of the rotor 303 of which is minimum (this means the spiral groove 311) has diameter larger than that of the bearing support 327. Thus, the water discharged from the spiral groove 311 is easily fed toward the periphery of the first pressure chamber 322, so that energy loss, which occurs by collision between the water from the spiral groove 311 and the bearing support 327 for supporting the thrust bearing 326, can be decreased.

The recess, the diameter of which is larger than that of the bearing support 327, is not limited as above embodiment (spiral groove 311). For example, as described in Japanese laid open publication document Hei 10-246193, an axial fan having projections and recesses formed by layer of many core plates can be used. In case a screw having plural inclined fans or an axial fan so-called impeller is provided, the recess means the joint of the fans to the rotary axis.

What the diameter of the recess of the axial fan is set larger than that of the bearing support 327, in other words, it means that the diameter of the axial fan is determined so as to easily flow water toward the outer area in radial direction of the bearing support 327. The axial fan 308 of the present embodiment satisfies the condition, so that the energy loss, which occurs by collision between the water from the spiral groove 311 and the bearing support 327 for supporting the thrust bearing 326, can be decreased.

As shown in FIG. 25, axial fan 308 provides the spiral groove 311 on the periphery of the pillar 308. To form "w" and "h" as smaller as possible, channel resistance decreases and efficiency improves. However, "w" is formed larger and larger so as to be "w<h" in condition "h" is constant, laminar state of water is destroyed, so that the turbulent flow such that water is returned to the outlet of the spiral groove 311, to decrease the efficiency for water feeding. However, the width "w" and the depth "h" of the spiral groove 311 are formed almost equal, so that water can be fed in efficiency.

Figure 26:
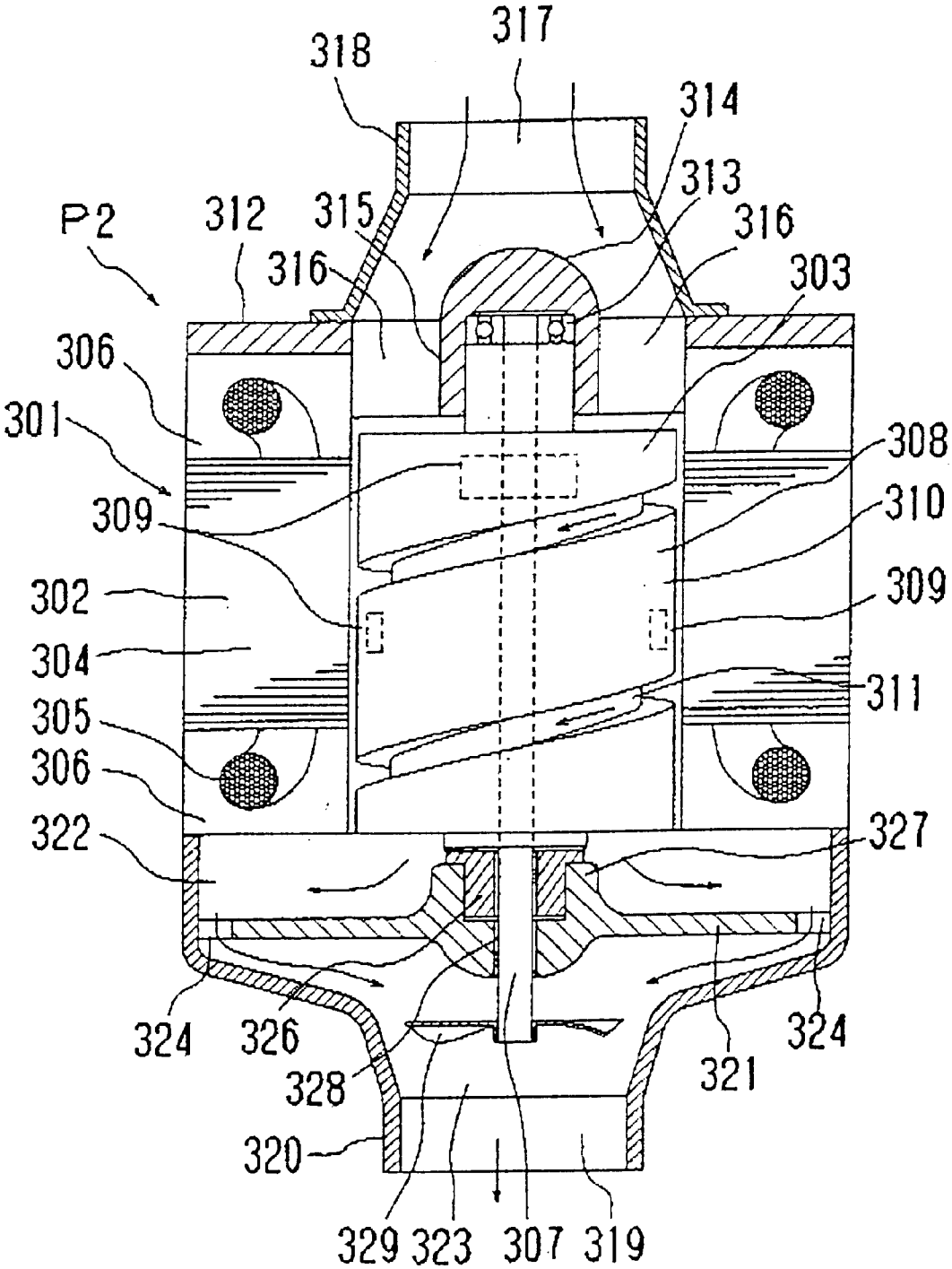
FIG. 26 is a vertical sectional view illustrating the structure of other motor-driven pump used for the swimming assistance apparatus according to the present invention.

Other embodiment of the in-line type motor-driven pumps P is now explained with reference to FIG. 26. FIG. 26 is a vertical sectional view illustrating the structure of other motor-driven pump P according to the present invention. The same parts as those in the former embodiment are designated by the same-reference numerals, and are not again explained herein.

The rotary axis 307 of the rotor 303 is extended into the second pressure chamber 323. A second axial fan 329 is fixedly provided at the extended portion of the rotary axis 307. An axial impeller is used for the second axial fan 329.

In operation, water can be fed with pressure dispersion by the axial fan 308 provided at inner portion of the stator 302 and the second axial fan provided in the second pressure chamber 323. The driving power of the motor 301 also can be dispersed. Thus, the second axial fan 329 can make up for insufficient of driving power for feeding water by the axial fan 308 in case rotor 303. was small-sized. Accordingly, small sizing of the motor 301 is satisfied with efficiency for feeding water.

Figure 27:
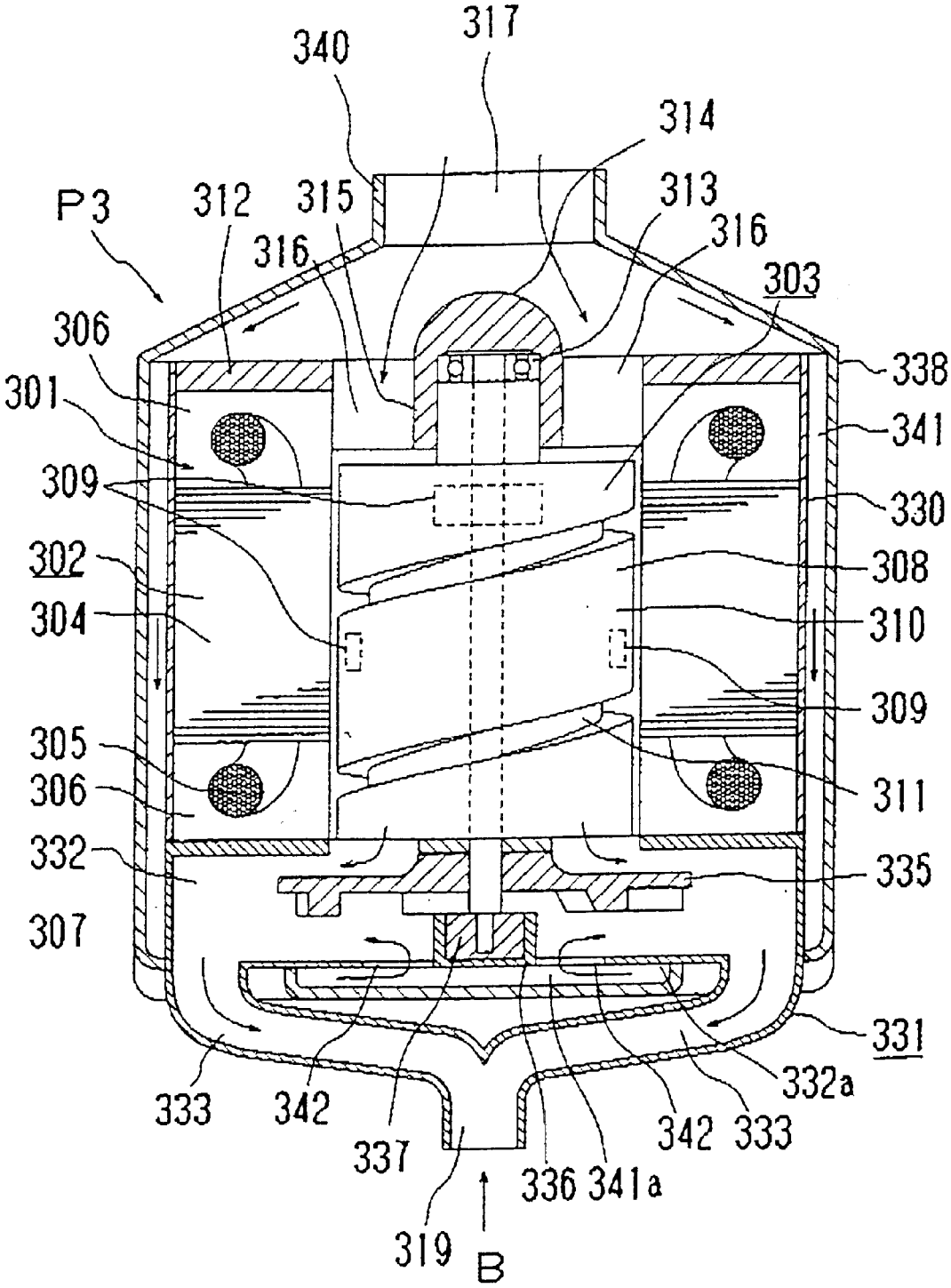
FIG. 27 is a vertical sectional view illustrating the structure of other motor-driven pump used for the swimming assistance apparatus according to the present invention.
Figure 28:
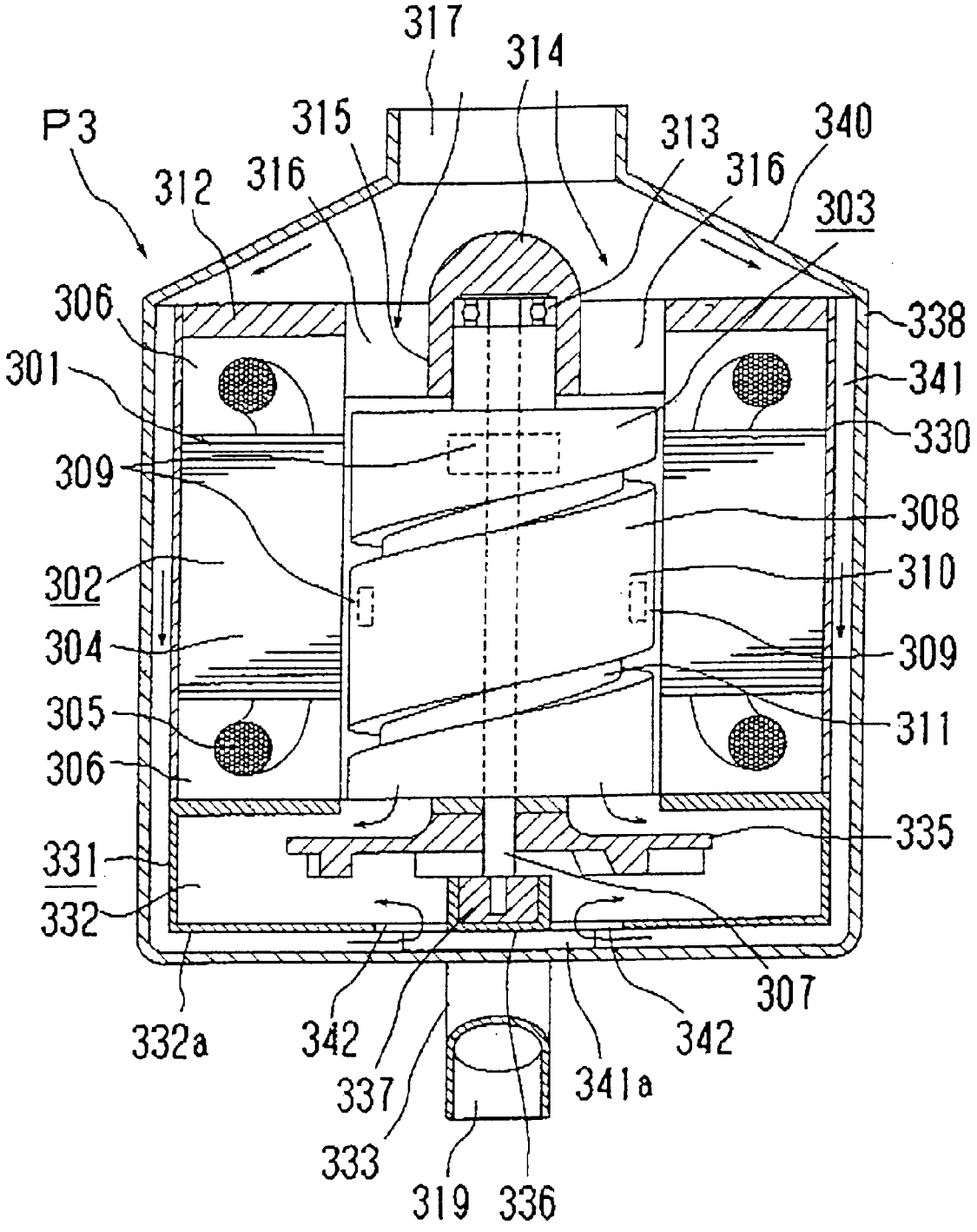
FIG. 28 is a vertical sectional view illustrating the structure of the motor-driven pump shown in FIG. 25 in right-angled direction according to the present invention.
Figure 29:
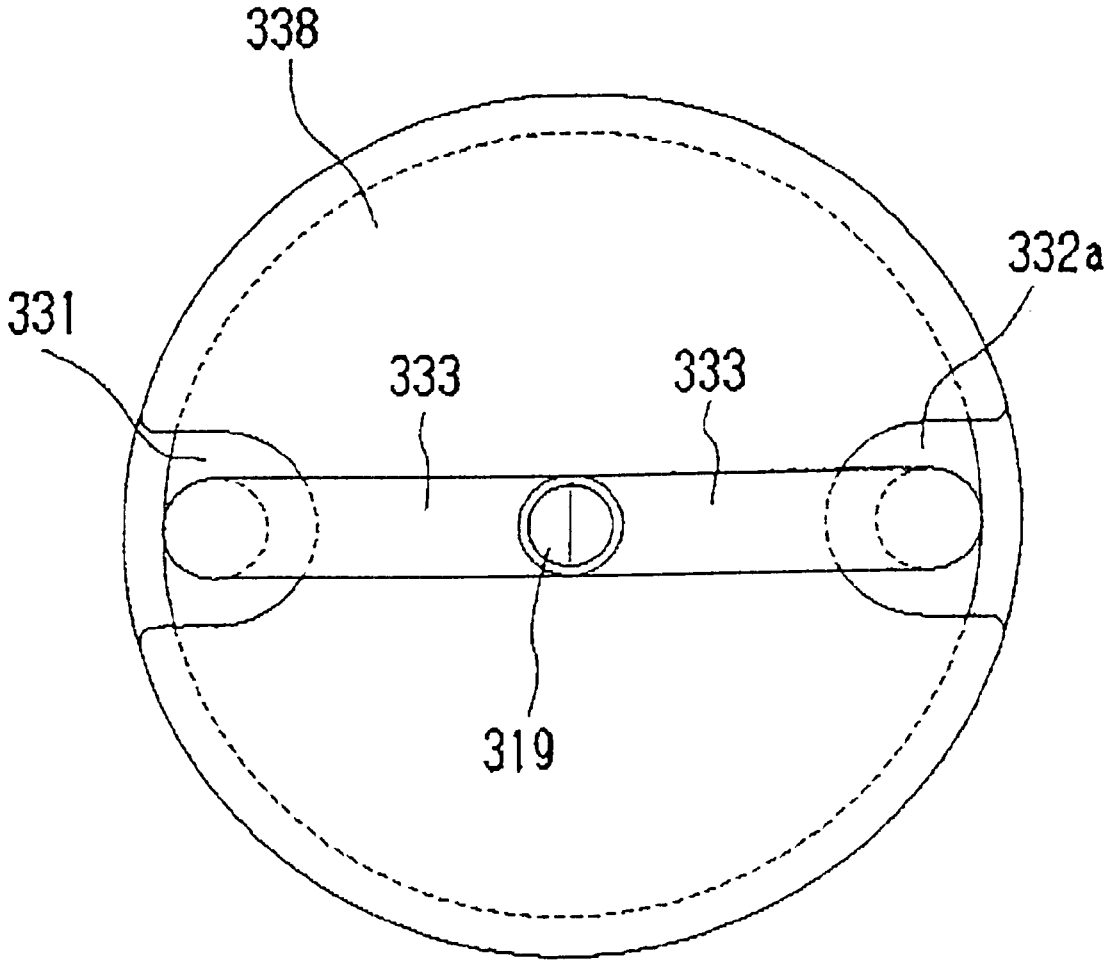
FIG. 29 is a bottom view of the motor-driven pump shown in direction of arrow B of FIG. 25 according to the present invention.

Other embodiment of the in-line type motor-driven pumps P is now explained with reference-to FIGS. 27 to 29. FIG. 27 is a vertical sectional view illustrating the structure of other motor-driven pump P according to the present invention. FIG. 28 is a vertical sectional view illustrating the structure of the motor-driven pump P shown in FIG. 25 in right-angled direction according to the present invention. FIG. 29 is a bottom view of the motor-driven pump P shown in direction of arrow B of FIG. 25 according to the present invention. The same parts as those in the former embodiment are designated by the same reference numerals, and are not again explained herein.

The motor 301 of the present embodiment provides a cylinder 330 for covering the stator 302. A connect cap 331 is provided at the end (lower end in FIG. 27 and 28) of the motor 301. The connect cap 331 provides a pressure chamber 332 for transforming rotation kinetic energy of water sucked by the axial fan 308 to static pressure energy, and a pair of pipe-like guide channels 333 extended from two peripheral portions out of 180 degrees of the pressure chamber 333 toward lower direction. The guide channels 333 are joined at extended portion on the axis of the rotor 303 so as to form a water outlet 319 at the joined portion. A centrifugal fan 335 is fixedly provided on the near lower end of the rotary axis 307 of the rotor 303 in the pressure chamber 332. The lower end of the rotary axis 307 penetrated in the centrifugal fan 335 is rotatably supported by a thrust bearing 337 supported on a bearing support 336 provided at the center portion of the connect cap 331.

338 designates to casing. A water inlet member 340 having a water inlet 317 covers an opening of the casing 338. The casing 338 houses the motor 301 and partially the connect cap 331.

FIG. 29 is a bottom view of the motor-driven pump P shown in direction of arrow B of FIG. 25. 332*a* designates to a bottom of the pressure chamber 332. The bottom 332*a* is formed as disk-like so as to be suitable for bottom form of the motor 301. The guide channels 333 are formed so as to bare form bottom of the casing 338.

There is provided a suction channel 341 for sucking water into the portion between the periphery of the motor 301 and connect cap 331 and the inner periphery of the case 338. The suction channel 341, as shown in FIGS. 27 and 28 with arrow, introduces water sucked from the water inlet 317 into the pressure chamber 332 via the periphery of the stator 302 to feed water toward the surface opposite to the axial fan 308 of the centrifugal fan 335. That is, the suction channel 341, as shown in FIG. 27, provides a connect portion 341*a* for connecting with a pair of connect holes 342 formed at a bottom 332*a* of the pressure chamber 332 in symmetric on the axis of the rotary axis 307. The connect portion 341*a*, as apparent from FIG. 27, is arranged so as to pass through the area between the bottom 332*a* of the pressure chamber 332 and the guide channel 333.

In operation, when the rotor 303 was rotated, the water sucked from the water inlet 317 is straighten by the straightening plate 316 formed at the inner space 315 of the flange 312, and is fed with pressure to the pressure chamber 332 by rotation of the axial fan 308. The water sucked from the water inlet 317 is also introduced into the pressure chamber 332 via the suction channel 341 as another suction system. The water introduced into the pressure chamber 332 by two different suction system will exhaust from the water outlet 319 with rotation of the centrifugal fan 335. Thus,.the water can be fed in efficiency.

The centrifugal fan 335 driven with the axial fan 308 is added the pressure by the water fed with the axial fan 308 at upper surface and the pressure by the water fed from the connect portion 341*a* of the suction channel 341 at lower surface. Thus, the both pressures are offset each other so as to decrease thrust load to the rotor 303 by the water.

Further, almost are of the suction channel 341 formed by the space between the motor 301 and pressure chamber 332 has constant sectional size with ring-like form. And the connect portion 341*a* partially forming the suction channel 341 and the guide channel 333 of the connect cap 331 is formed symmetrically on the axis of the rotary axis 307 of the rotor 303. Accordingly, the suction channel 341 and the guide channel 333 is formed so as to make the energy of flow symmetrically on the axis of the rotor 303, so that the load to the rotor 303 in radial direction is also decreased. Consequently, long life of the bearing 313, the thrust bearing 337 and the rotary axis 307 can be obtained whereby the motor 301 can be driven to rotate smoothly for long time.

Figure 30:
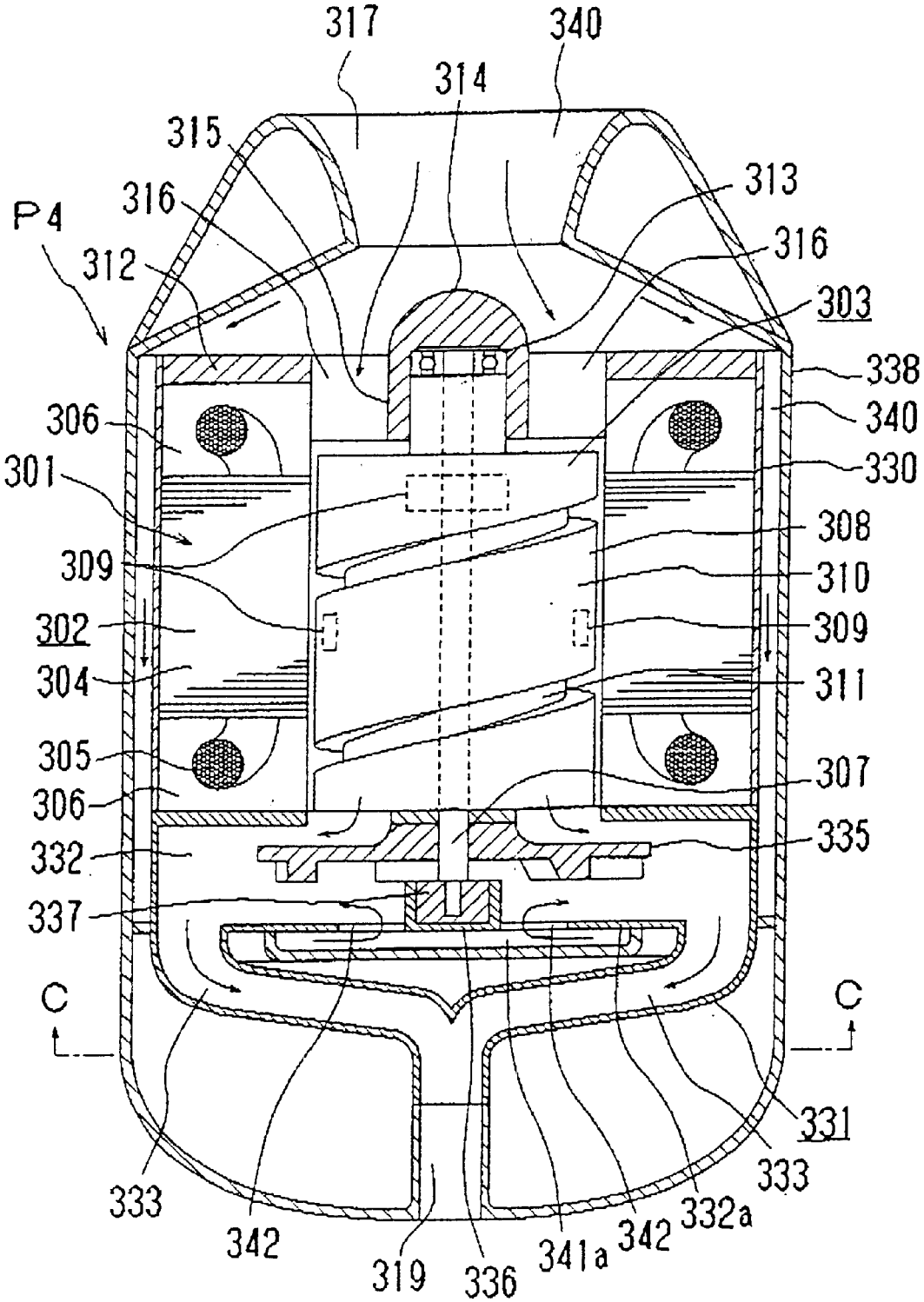
FIG. 30 is a vertical sectional view illustrating the preferred structure of other motor-driven pump used for the swimming assistance apparatus according to the present invention.
Figure 31:
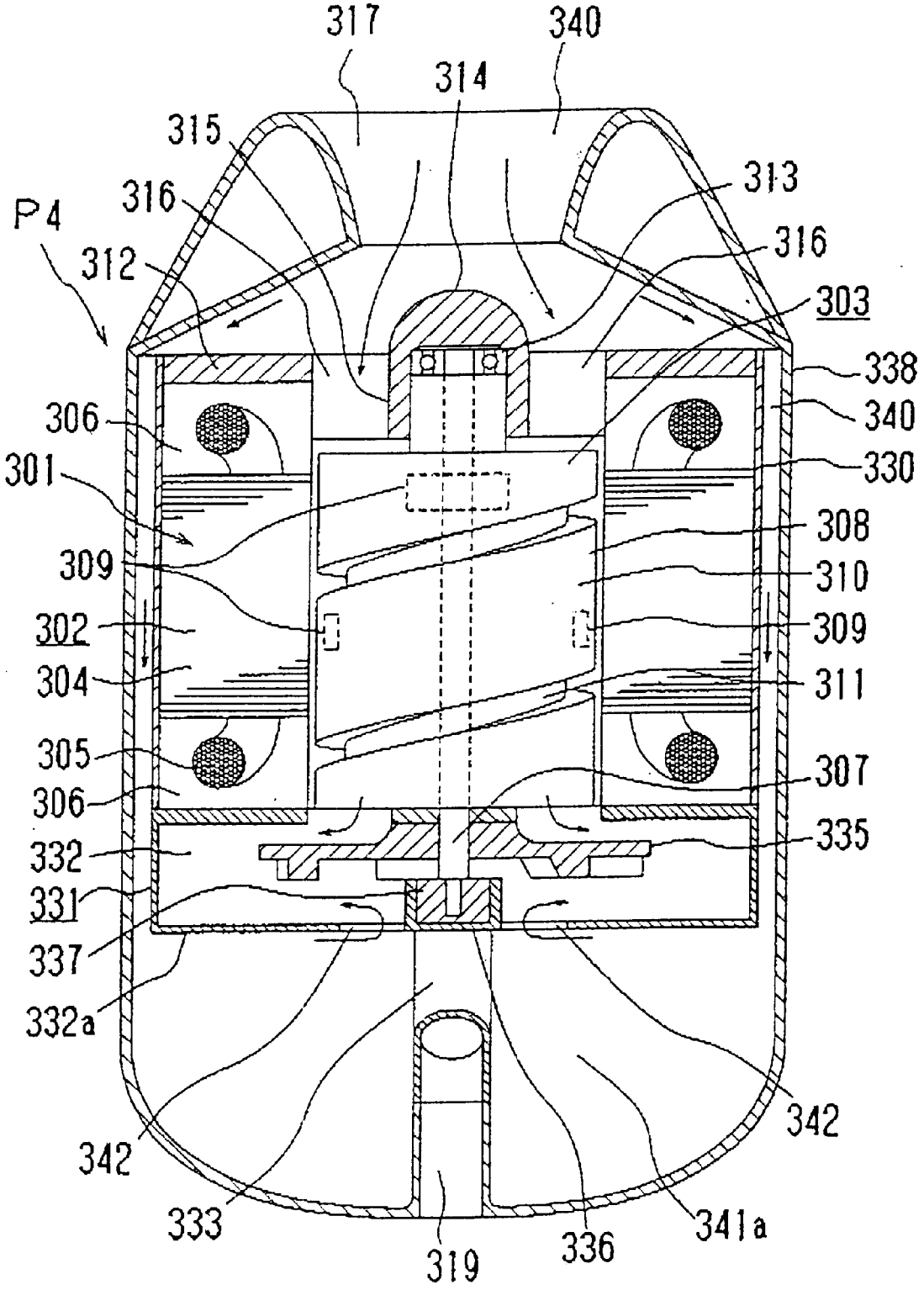
FIG. 31 is a vertical sectional view illustrating the structure of the motor-driven pump shown in FIG. 28 in right-angled direction according to the present invention.
Figure 32:
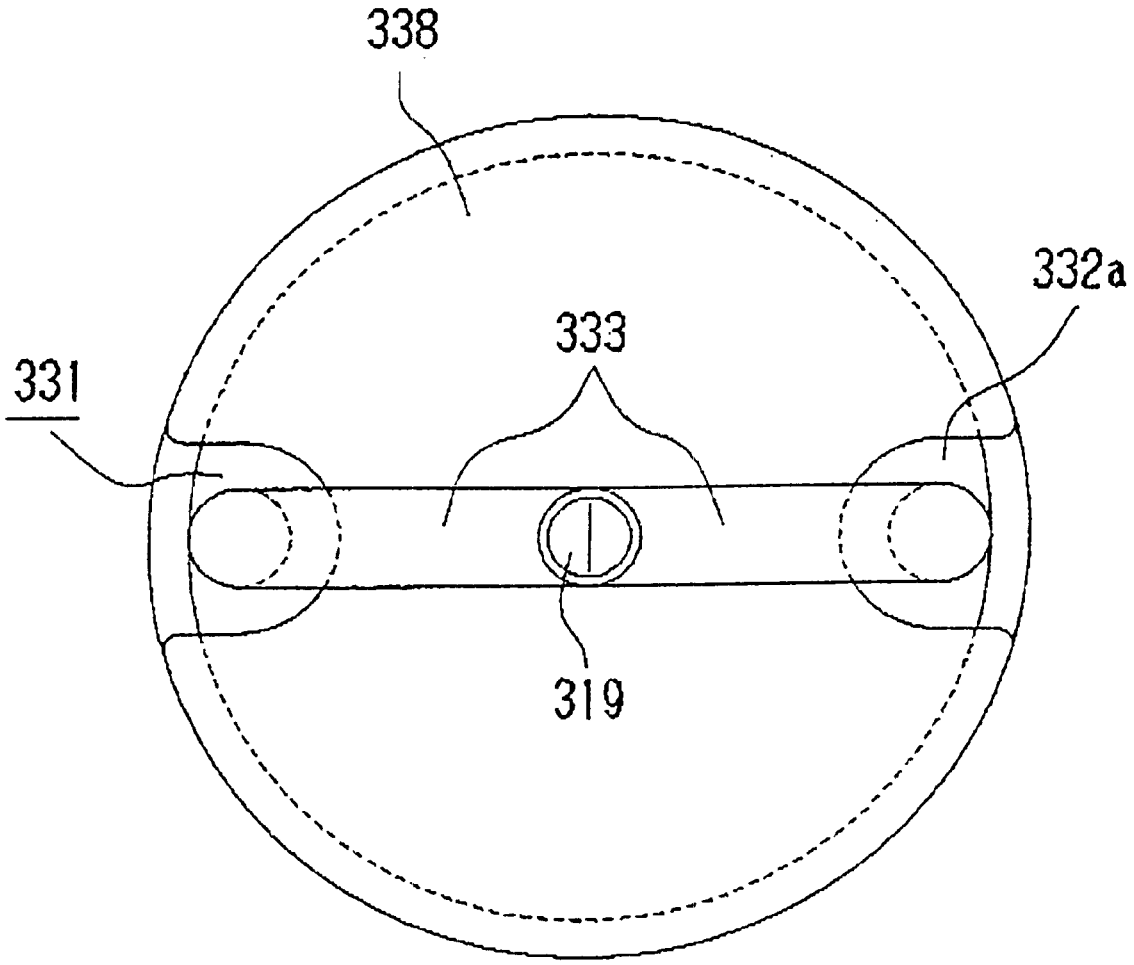
FIG. 32 is a sectional view taken substantially along the lines C—C of FIG. 28.

Other embodiment of the in-line type motor-driven pumps is now explained with reference to FIGS. 30 to 32. FIG. 30 is a vertical sectional view illustrating the other motor-driven pump P according to the present invention. FIG. 31 is a vertical sectional view illustrating the structure of the motor-driven pump P shown in FIG. 28 in right-angled direction according to the present invention. FIG. 32 is a sectional view taken substantially along the lines C—C of FIG. 28. The same parts as those in the former embodiment are designated by the same reference numerals, and are not again explained herein.

The motor-driven pump P according to the present embodiment can be preferably used for sixth embodiment of the present invention.

The basic structure of the motor-driven pump P according to the present embodiment is same to third embodiment of the motor-driven pump P. Only difference to that is a form of the casing 338. That is, the casing 338 is formed with smooth line at the portions for the water inlet 317 and the water outlet 319 so as to decrease the resistance to water (liquid).

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Documents Hei 11-144870 filed on May 25, 1999, Hei 11-198778 filed on Jul. 13, 1999, and 2000-35904 filed on Feb. 14, 2000, the content of which are incorporated herein by reference.

We claim:

1. A swimming assistance apparatus comprising:

a base adaptable to be combined with a human body; and a motor-driven pump provided in the base, the motor-driven pump has a water inlet and a water outlet to operate by a battery so as to generate water flow from the water inlet to the water outlet, wherein the motor-driven pump is an in-line motor-driven pump including:

a cylindrical stator;

a rotor provided inside of the stator, having an axial fan for feeding water from the water inlet to the water outlet;

a first pressure chamber for transforming rotation kinetic energy with respect to water directing to the water outlet by the rotation of the axial fan to static pressure energy;

a second pressure chamber disposed between the first pressure chamber and the water outlet, the first pressure chamber and the second pressure chamber are divided by a separator; and at least one guide hole provided in the separator to connect the first pressure chamber with the second pressure chamber.

2. The swimming assistance apparatus according to claim 1, wherein the in-line motor-driven pump further comprising:

a thrust bearing provided on the separator to rotatably support an axis of the rotor; and a leakage channel connecting the inner surface of the thrust bearing with the second pressure chamber.

3. The swimming assistance apparatus according to claims 1 or 2, wherein a second axial fan is provided in the second pressure chamber so as to rotate with the rotor.

4. The swimming assistance apparatus according to claims 1 or 4, wherein the diameter of the bottom portion of the axial fan is smaller than that of a bearing support supporting the thrust bearing.

5. The swimming assistance apparatus according to claims 1 or 4, wherein the axial fan has an approximately cylindrically-shaped outer periphery with a spiral grove formed therein such that a width and a depth of the spiral groove are almost equal.

6. A swimming assistance apparatus, comprising:

a base adaptable to be combined with a human body; and a motor-driven pump provided in the base, the motor-driven pump has a water inlet and a water outlet to operate by a battery so as to generate water flow from the water inlet to the water outlet, wherein the motor-driven pump is an in-line motor-driven pump including:

a cylindrical stator;

a rotor provided inside of the stator, having an axial fan for feeding water from the water inlet to the water outlet;

a pressure chamber for transforming rotation kinetic energy with respect to water directing to the water outlet by the rotation of the axial fan to static pressure energy;

a centrifugal fan disposed in the pressure chamber so as to rotate with the rotor;

suction channel for introducing water fed from the water inlet into the pressure chamber at opposite side of the centrifugal fan via the periphery of the stator; and guide channel for introducing water in the pressure chamber from the periphery into the water outlet by rotation of the centrifugal fan.

7. The swimming assistance apparatus according to claim 6, wherein a connecting portion, connecting the pressure chamber and the guide channel, is arranged so as to make water energy symmetrical on the rotary axis of the rotor.

8. A swimming assistance apparatus comprising:

a buoyant hull having a pair of grips at front sides and a controller adjacent to the grips;

a motor-driven pump, provided in the hull, having a water inlet and a water outlet to operate by a battery so as to generate water flow from the water inlet to the water outlet, wherein the motor-driven pump is provided at a rear center portion of the hull; and a control device for controlling power of the motor-driven pump according to operation of the controller, wherein a pair of the water inlets of the motor-driven pump are provided at the bottom of the hull so as to be disposed adjacent to right and left portions with respect to the center of gravity of the hull.

9. A swimming assistance apparatus comprising:

a buoyant hull having a pair of grips at front sides and a controller adjacent to the grips;

a motor-driven pump, provided in the hull, having a water inlet and a water outlet to operate by a battery so as to generate water flow from the water inlet to the water outlet, wherein a first and second of the motor-driven pump are provided at rear right and left portions of the hull, respectively; and a control device for controlling power of the motor-driven pump according to operation of the controller, wherein a chamber of the battery is disposed adjacent to the center of gravity of the hull.

10. A swimming assistance apparatus comprising:

a buoyant hull having a pair of grips at front sides and a controller adjacent to the grips;

a motor-driven pump, provided in the hull, having a water inlet and a water outlet to operate by a battery so as to generate water flow from the water inlet to the water outlet, wherein the motor-driven pump is an in-line motor-driven pump including:

a cylindrical stator;

a rotor provided inside of the stator, having an axial fan for feeding water from the water inlet to the water outlet;

a first pressure chamber for transforming rotation kinetic energy with respect to water directing to the water outlet by the rotation of the axial fan to static pressure energy;

a second pressure chamber disposed between the first pressure chamber and the water outlet, the first pressure chamber and the second pressure chamber are divided by a separator; and at least one guide hole provided in the separator to connect the first pressure chamber with the second pressure chamber; and a control device for controlling power of the motor-driven pump according to operation of the controller.

11. The swimming assistance apparatus according to claim 10, wherein the in-line motor-driven pump further comprising:

a thrust bearing provided on the separator to rotatably support an axis of the rotor; and a leakage channel connecting the inner surface of the thrust bearing with the second pressure chamber.

12. The swimming assistance apparatus according to claims 10 or 11, wherein a second axial fan is provided in the second pressure chamber so as to rotate with the rotor.

13. The swimming assistance apparatus according to claims 10 or 11, wherein the diameter of the bottom portion of the axial fan is smaller than that of a bearing support supporting the thrust bearing.

14. The swimming assistance apparatus according to claims 10 or 11, wherein the axial fan has an approximately cylindrically-shaped outer periphery with a spiral grove formed therein such that a width and a depth of the spiral groove are almost equal.

15. A swimming assistance apparatus comprising:

a buoyant hull having a pair of grips at front sides and a controller adjacent to the grips;

a motor-driven pump, provided in the hull, having a water inlet and a water outlet to operate by a battery so as to generate water flow from the water inlet to the water outlet, wherein the motor-driven pump is an in-line motor-driven pump including:

a cylindrical stator;

a rotor provided inside of the stator, having an axial fan for feeding water from the water inlet to the water outlet;

a pressure chamber for transforming rotation kinetic energy with respect to water directing to the water outlet by the rotation of the axial fan to static pressure energy;

a centrifugal fan disposed in the pressure chamber so as to rotate with the rotor;

suction channel for introducing water fed from the water inlet into the pressure chamber at opposite side of the centrifugal fan via the periphery of the stator; and guide channel for introducing water in the pressure chamber from the periphery into water outlet by rotation of the centrifugal fan; and a control device for controlling power of the motor-driven pump according to operation of the controller.

16. The swimming assistance apparatus according to claim 15, wherein a connecting portion connecting the pressure chamber and the guide channel is arranged so as to make water energy symmetrical on the rotary axis of the rotor.

17. A swimming assistance apparatus comprising a base having a handle, the buoyancy of which is set so as to be a little more than 0;

a motor-driven pump provided in a channel which connects a water inlet disposed in the draught of the front portion of the base or the bottom of the base with a water outlet disposed in the draught of the rear portion of the base to operate by a battery so as to generate water flow from the water inlet to the water outlet, wherein the swimming assistance apparatus is driven by reaction of the water flow generated by the motor-driven pump; and a buoyancy adjust chamber to store water in desired amount so as to adjust the buoyancy of the body.

18. The swimming assistance apparatus according to claim 17, wherein the buoyancy adjust chamber connects with a water channel provided in the motor-driven pump via an inlet and outlet channel and with air via an inlet and outlet channel.

19. The swimming assistance apparatus according to claim 17, wherein the buoyancy adjust chamber is disposed above the battery.

20. A swimming assistance apparatus comprising:

a base having a handle, the buoyancy of which is set so as to be a little more than 0; and a motor-driven pump provided in a channel which connects a water inlet disposed in the draught of the front portion of the base or the bottom of the base with a water outlet disposed in the draught of the rear portion of the base to operate by a battery so as to generate water flow from the water inlet to the water outlet, wherein the swimming assistance apparatus is driven by reaction of the water flow generated by the motor-driven pump, and wherein the motor-driven pump is an in-line motor-driven pump including:

a cylindrical stator;

a rotor provided inside of the stator, having an axial fan for feeding water from the water inlet to the water outlet;

a first pressure chamber for transforming rotation kinetic energy with respect to water directing to the water outlet by the rotation of the axial fan to static pressure energy;

a second pressure chamber disposed between the first pressure chamber and the water outlet, the first pressure chamber and the second pressure chamber are divided by a separator; and at least one guide hole provided in the separator to connect the first pressure chamber with the second pressure chamber.

21. The swimming assistance apparatus according to claim 20, wherein the in-line motor-driven pump further comprising:

a thrust bearing provided on the separator to rotatably support an axis of the rotor; and a leakage channel connecting the inner surface of the thrust bearing with the second pressure chamber.

22. The swimming assistance apparatus according to claims 20 or 21, wherein a second axial fan is provided in the second pressure chamber so as to rotate with the rotor.

23. The swimming assistance apparatus according to claims 20 or 21, wherein the diameter of the bottom portion of the axial fan is smaller than that of a bearing support supporting the thrust bearing.

24. The swimming assistance apparatus according to claims 20 or 21, wherein the axial fan has an approximately cylindrically-shaped outer periphery with a spiral grove formed therein such that a width and a depth of the spiral groove are almost equal.

25. A swimming assistance apparatus comprising:

a base having a handle, the buoyancy of which is set so as to be a little more than 0; and a motor-driven pump provided in a channel which connects a water inlet disposed in the draught of the front portion of the base or the bottom of the base with a water outlet disposed in the draught of the rear portion of the base to operate by a battery so as to generate water flow from the water inlet to the water outlet, wherein the swimming assistance apparatus is driven by reaction of the water flow generated by the motor-driven pump, and wherein the motor-driven pump is an in-line motor-driven pump including:

a cylindrical stator;

a rotor provided inside of the stator, having an axial fan for feeding water from the water inlet to the water outlet;

a pressure chamber for transforming rotation kinetic energy with respect to water directing to the water outlet by the rotation of the axial fan to static pressure energy;

a centrifugal fan disposed in the pressure chamber so as to rotate with the rotor;

suction channel for introducing water fed from the water inlet into the pressure chamber at opposite side of the centrifugal fan via the periphery of the stator; and guide channel for introducing water in the pressure chamber from the periphery into water outlet by rotation of the centrifugal fan.

26. The swimming assistance apparatus according to claim 25, wherein a connecting portion connecting the pressure chamber and the guide channel is arranged so as to make water energy symmetrical on the rotary axis of the rotor.

27. A swimming assistance comprising:

a belt adaptable to be detachably attached to a trunk of a human body;

a motor-driven pump having a water inlet and a water outlet and provided on the belt so as to position the water inlet on the head side of the human body and the water outlet on the legs side of the human body, the motor-driven pump operates by a battery so as to generate water flow from the water inlet to the water outlet, wherein the motor-driven pump is an in-line motor driven pump including:

a cylindrical stator;

a rotor provided inside of the stator, having an axial fan for feeding water from the water inlet to the water outlet;

a first pressure chamber for transforming rotation kinetic energy with respect to water directing to the water outlet by the rotation of the axial fan to static pressure energy;

a second pressure chamber disposed between the first pressure chamber and the water outlet, the first pressure chamber and the second pressure chamber are divided by a separator; and at least one guide hole provided in the separator to connect the first pressure chamber with the second pressure chamber;

a drive circuit provided on the belt in a watertight manner to as to drive and control the motor-driven pump; and a battery chamber provided on the belt to hold the battery in a watertight manner.

28. The swimming assistance apparatus according to claim 27, wherein the in-line type motor-driven pump further comprising:

a thrust bearing provided on the separator to rotatably support an axis of the rotor; and a leakage channel connecting the inner surface of the thrust bearing with the second pressure chamber.

29. The swimming assistance apparatus according to claims 27 or 28, wherein a second axial fan is provided in the second pressure chamber so as to rotate with the rotor.

30. The swimming assistance apparatus according to claims 27 or 28, wherein the diameter of the bottom portion of the axial fan is smaller than that of a bearing support supporting the thrust bearing.

31. The swimming assistance apparatus according to claims 27 or 28, wherein the axial fan has an approximately cylindrically-shaped outer periphery with a spiral grove formed therein such that a width and a depth of the spiral groove are almost equal.

32. A swimming assistance apparatus comprising:

a belt adaptable to be detachably attached to a trunk of a human body;

a motor-driven pump having a water inlet and a water outlet and provided on the belt so as to position the water inlet on the head side of the human body and the water outlet on the legs side of the human body, the motor-driven pump operates by a battery so as to generate water flow from the water inlet to the water outlet, wherein the motor-driven pump is an in-line motor driven pump including:

a cylindrical stator;

a rotor provided inside of the stator, having an axial fan for feeding water from the water inlet to the water outlet;

a pressure chamber for transforming rotation kinetic energy with respect to water directing to the water outlet by the rotation of the axial fan to static pressure energy;

a centrifugal fan disposed in the pressure chamber so as to rotate with the rotor;

suction channel for introducing water fed from the water inlet into the pressure chamber at opposite side of the centrifugal fan via the periphery of the stator; and guide channel for introducing water in the pressure chamber from the periphery into water outlet by rotation of the centrifugal fan;

a drive circuit provided on the belt in a watertight manner to as to drive and control the motor-driven pump; and a battery chamber provided on the belt to hold the battery in a watertight manner.

33. The swimming assistance apparatus according to claim 32, wherein a connecting portion connecting the pressure chamber and the guide channel is arranged so as to make water energy symmetrical on the rotary axis of the rotor.

34. A swimming assistance apparatus according to claims 27, 28, 32 or 33, wherein the belt comprising:

a belt member for bandaging the trunk of the human body;

a hook provided at one end of the belt member; and a catcher provided at another end of the belt member to catch the hook.

35. The swimming assistance apparatus according to claims 27, 28, 32 or 33, wherein a single casing houses the motor-driven pump, the drive circuit, and the battery chamber.

36. The swimming assistance apparatus according to claims 27, 28, 32 or 33, wherein the motor-driven pump is disposed at the stomach, while the belt member is attached to the human body.

37. A swimming assistance apparatus comprising:

a belt adaptable to be detachably attached to a trunk of a human body;

a motor-driven pump having a water inlet and a water outlet and provided on the belt so as to position the water inlet on the head side of the human body and the water outlet on the legs side of the human body, the motor-driven pump operates by a battery so as to generate water flow from the water inlet to the water outlet, wherein the motor-driven pump is an in-line motor driven pump including:

a cylindrical stator; and a rotor provided inside of the stator, having an axial fan for feeding water from the water inlet to the water outlet;

a drive circuit provided on the belt in a watertight manner to as to drive and control the motor-driven pump; and a battery chamber provided on the belt to hold the battery in a watertight manner, wherein a single casing houses the motor-driven pump, the drive circuit and the battery chamber.

38. A swimming assistance apparatus comprising:

a belt adaptable to be detachably attached to a trunk of a human body;

a motor-driven pump having a water inlet and a water outlet and provided on the belt so as to position the water inlet in high and the water outlet in low to the human body, the motor-driven pump operates by a battery so as to generate water flow from the water inlet to the water outlet;

a drive circuit provided on the belt in a watertight manner to as to drive and control the motor-driven pump;

a battery chamber provided on the belt to hold the battery in a watertight manner; and an optional function adding mechanism provided in the belt, the optional function adding mechanism comprising:

a fluid chamber for storing fluid;

an inlet and outlet for connect the inside of the fluid chamber with outside; and a valve for capping the inlet and outlet so as to be capable of opening the inlet and outlet to seal the fluid chamber.

39. The swimming assistance apparatus according to claim 38, wherein the optional function adding mechanism is detachably provided in the belt.

* * * * *